US012781577B2

(12) United States Patent
Fulks

(10) Patent No.: US 12,781,577 B2
(45) **Date of Patent: *Nov. 3, 2026**

(54) OMNIDIRECTIONAL SLIP BOWL

(71) Applicant: Consolidated Rig Works, L.P., Fort Worth, TX (US)

(72) Inventor: Caleb E.M. Fulks, McKinney, TX (US)

(73) Assignee: Consolidated Rig Works, L.P., Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/285,448

(22) Filed: Jul. 30, 2025

(65) Prior Publication Data

US 2025/0354442 A1 Nov. 20, 2025

Related U.S. Application Data

(63) Continuation-in-part of application No. 18/362,534, filed on Jul. 31, 2023, now Pat. No. 12,404,729.

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 1,803,608 A 5/1931 Goetz et al.
3,760,469 A * 9/1973 Brown ..... E21B 19/16 279/4.06
4,269,277 A * 5/1981 Baugh ..... E21B 19/10 173/149
4,478,292 A * 10/1984 Baugh ..... B23B 5/163 173/159
4,576,254 A * 3/1986 Cox ..... E21B 19/10 279/4.06
4,828,293 A 5/1989 Vanderford, Jr. et al.
(Continued)

*Primary Examiner* — Blake Michener

(57) ABSTRACT

An omnidirectional slip bowl comprises a support frame having a central axis and defining an opening therein to receive a tubular passing into or coming out of a wellbore. A pair of pivot arms moves between an open configuration and a closed configuration. Each pair of pivot arms are located on opposite sides of the support frame. A plurality of actuators each have a first end connected to one of the pair of pivot arms. Each of the plurality of actuators moves the associated pivot arm between the open configuration and the closed configuration. A plurality of pairs of gripper assemblies associated with each pair of pivot arms lock the tubular in a fixed position and prevent movement of the tubular into or out of the wellbore. When the pair of pivot arms are in the closed configuration and the tubular is moving out of the wellbore, the pairs of gripper assemblies move in a first direction along the plurality of pivot arms and engage the tubular to prevent the tubular moving out of the wellbore. When the pair of pivot arms are in the closed configuration and the tubular is moving into the wellbore, the pairs of gripper assemblies move in a second direction along the pivot arm and engage the tubular to prevent the tubular moving into the wellbore.

21 Claims, 23 Drawing Sheets

(56) References Cited

U.S. PATENT DOCUMENTS

| | | | | |
|---|---|---|---|---|
| 4,940,118 | A * | 7/1990 | Cox | E21B 19/10 294/102.2 |
| 5,027,926 | A * | 7/1991 | Cox | E21B 19/10 294/102.2 |
| 6,199,641 | B1 * | 3/2001 | Downie | E21B 19/10 173/55 |
| 2010/0116558 | A1 | 5/2010 | Angelle et al. | |
| 2015/0159445 | A1 | 6/2015 | Smith et al. | |

* cited by examiner

OMNIDIRECTIONAL SLIP BOWL

CROSS-REFERENCE TO RELATED APPLICATIONS

This application is a continuation-in-part of U.S. application Ser. No. 18/362,534, filed Jul. 31, 2023, entitled OMNIDIRECTIONAL SLIP BOWL, the specifications of which are incorporated by reference herein in their entirety.

TECHNICAL FIELD

The present invention relates to slip bowls for snubbing equipment and hydraulic work over units, and more particularly, to a slip bowl that can prevent oilfield tubulars used downhole from movement in both the in-hole direction and the out-of-hole direction simultaneously.

BACKGROUND

A slip bowl is used to maintain control over oilfield tubulars such as drill string, production pipe, or well bore casing as they are being introduced into or removed from a well bore. For purposes of this application, unless otherwise indicated the term "tubulars" and "oilfield tubulars" refer to drill pipe, drill strings, production pipe, production strings, jointed pipe and collars, jointed and continuous tubing, casing and other types of oilfield tubular members and strings formed of such tubular members. Slip bowls have been an integral part of the snubbing service industry for the past 50 years. Existing sizes and styles of traditional slip bowls are designed to support pipe weight in only one direction. The slip bowl operates as a mechanical check valve, allowing pipe to move freely in one direction but not in the opposite direction when the bowl is closed. Current designs require snubbing units to have a set of two slip bowls. Each set has one bowl right side up to handle pipe-heavy weight (i.e., load directed down into the well bore when the pipe weight exceeds the force from well pressure) and one bowl upside down to handle pipe-light weight (i.e., load directed out of the well bore when the force from well pressure exceeds the pipe weight). Thus, two bowls are required to hold the pipe in two directions. Additionally, traditional slip bowls are not rated to handle rotational torque loads. Thus, there is a need for a new type of slip bowl that has the capability of supporting drill pipe in both axial directions and to transmit rotational loads.

SUMMARY

The present invention, as disclosed and described herein, in one aspect thereof comprises an omnidirectional slip bowl having a support frame with a central axis and defining an opening therein to receive a tubular passing into or coming out of a wellbore. A pair of pivot arms moves between an open configuration and a closed configuration. Each pair of pivot arms are located on opposite sides of the support frame. A plurality of actuators each having a first end connected to one of the pair of pivot arms. Each of the plurality of actuators moves the associated pivot arm between the open configuration and the closed configuration. A plurality of pairs of gripper assemblies associated with each pair of pivot arms lock the tubular in a fixed position and prevent movement of the tubular into or out of the wellbore. When the pair of pivot arms are in the closed configuration and the tubular is moving out of the wellbore, the pairs of gripper assemblies move in a first direction along the plurality of pivot arms and engage the tubular to prevent the tubular moving out of the wellbore. When the pair of pivot arms are in the closed configuration and the tubular is moving into the wellbore, the pairs of gripper assemblies move in a second direction along the pivot arm and engage the tubular to prevent the tubular moving into the wellbore.

BRIEF DESCRIPTION OF THE DRAWINGS

For a more complete understanding, reference is now made to the following description taken in conjunction with the accompanying Drawings in which.

DETAILED DESCRIPTION

Figure 1:
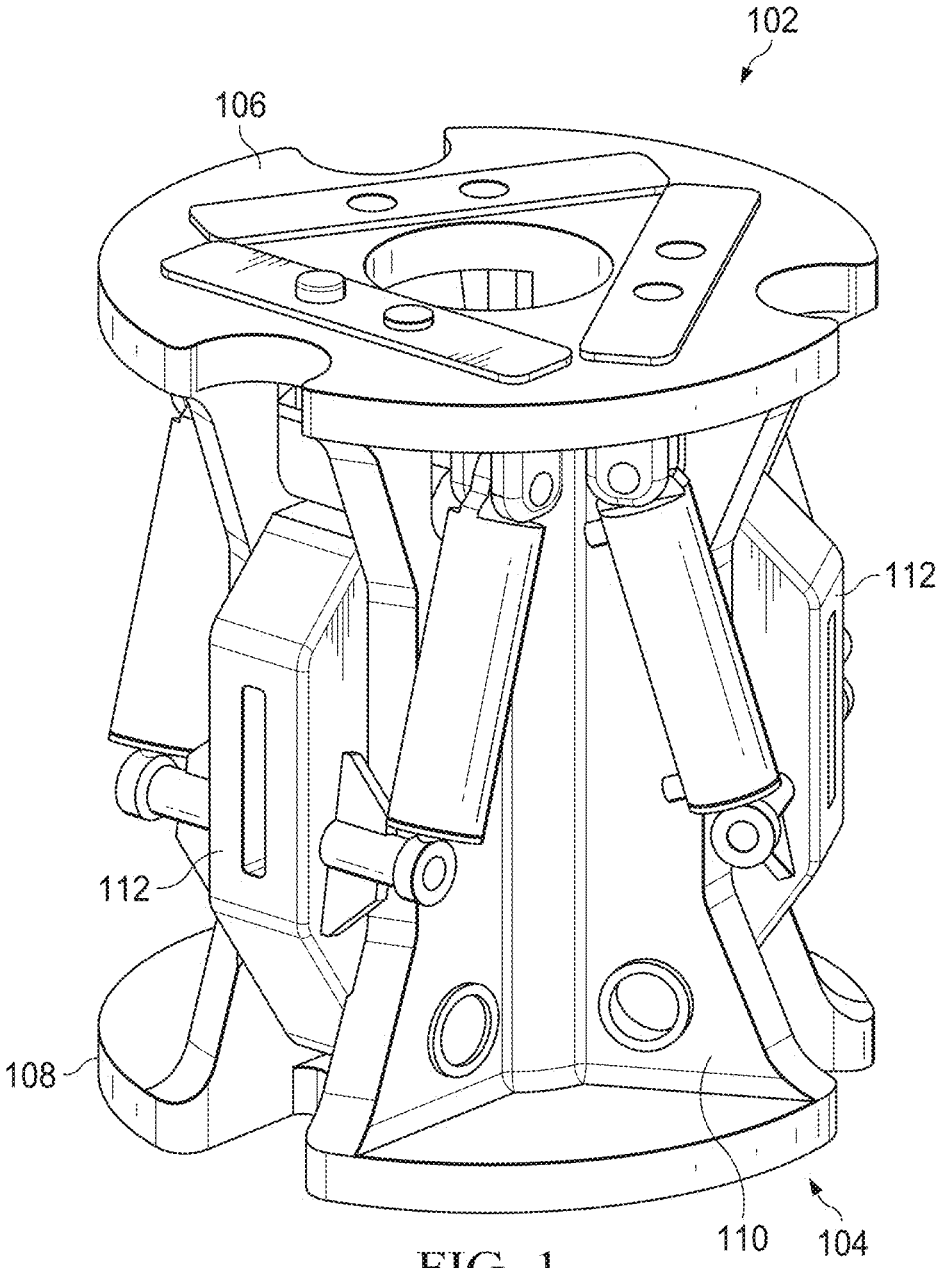
FIG. 1 illustrates a perspective view of an omnidirectional slip bowl in a closed configuration.

Referring now to the drawings, wherein like reference numbers are used herein to designate like elements throughout, the various views and embodiments of an omnidirectional slip bowl are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
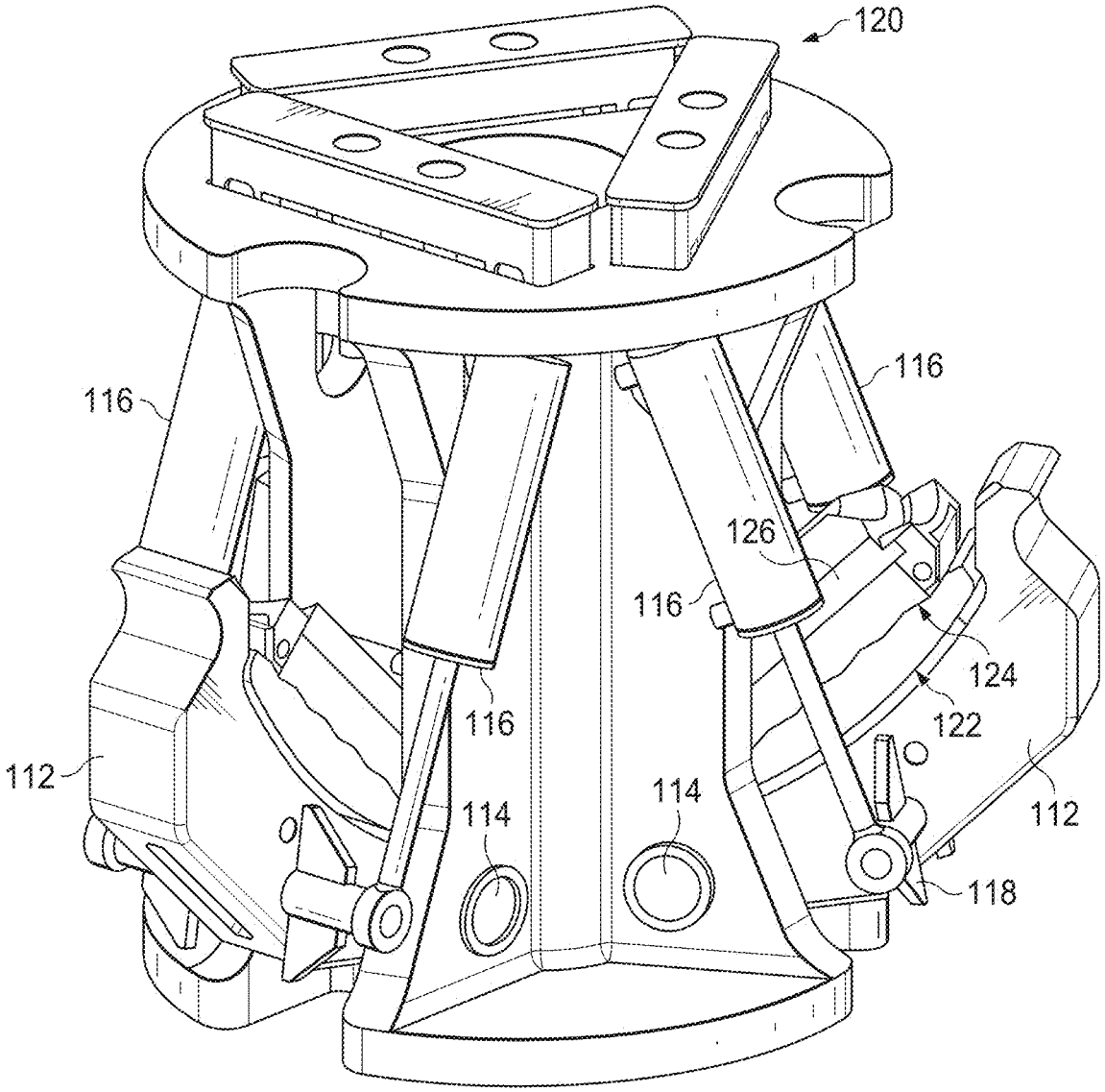
FIG. 2 illustrates a perspective view of an omnidirectional slip bowl in an open configuration.

Referring now to the drawings, and more particularly to FIGS. 1 and 2, there are illustrated perspective views of the omnidirectional slip bowl in both the closed configuration (FIG. 1) and open configuration (FIG. 2). The omnidirectional slip bowl 102 has a support frame 104 including a top plate 106 and the lower plate 108 that are interconnected by a central support frame 110. While the current embodiment illustrates a support frame other shapes of the support frame may be used. The top plate 106, the lower plate 108 and the central support frame 110 define a circular opening therein to enable tubulars to pass through the support frame 104. A number of pivot arms 112 are pivotally connected to the central support frame 110 at respective pivot pins 114. While FIGS. 1 and 2 illustrate the use of three pivot arms 112 within the slip bowl 102, it will be appreciated by one skilled in the art that a greater or lesser number of pivot arms 112 may be used for gripping tubulars inserted within the slip bowl 102 in order to prevent the tubulars from moving within the slip bowl.

The pivot arms 112 pivot between the closed position as illustrated in FIG. 1 and an open position as illustrated in FIG. 2. Each pivot arm 112 is actuated between the closed position and the open position utilizing a pair of hydraulic cylinders 116. The hydraulic cylinders 116 pivotally interconnect at a first end to the pivot arm 112 at a support bracket 118 and to a cylinder mount 120 at a second end of the hydraulic cylinder 116. When in the closed position, the slip bowl 102 is capable and rated for transmitting rotational torque loads to tubulars gripped by the slip bowl.

The pivot arm 112 has mounted thereon a slip plate 122. When the slip bowl is in the closed configuration, the slide plate 122 moves up and down along an interior arc-shaped face of the pivot arm 112 in order to maintain engagement of the slip bowl with the tubular located within the slip bowl 102. The slide plate 122 engages a carrier 124 that moves up and down along the inner face of the pivot arm 112 in association with the slide plate 122. A gripping insert 126 is mounted within the carrier 124. The gripping insert 126 includes a surface, as will be more particularly described hereinbelow, for engaging the surface of the pipe or casing that is inserted within the slip bowl 102. The gripping insert 126 prevents the tubular from moving perpendicularly to the central axis of the support frame 104 when gripping the tubular.

Figure 3:
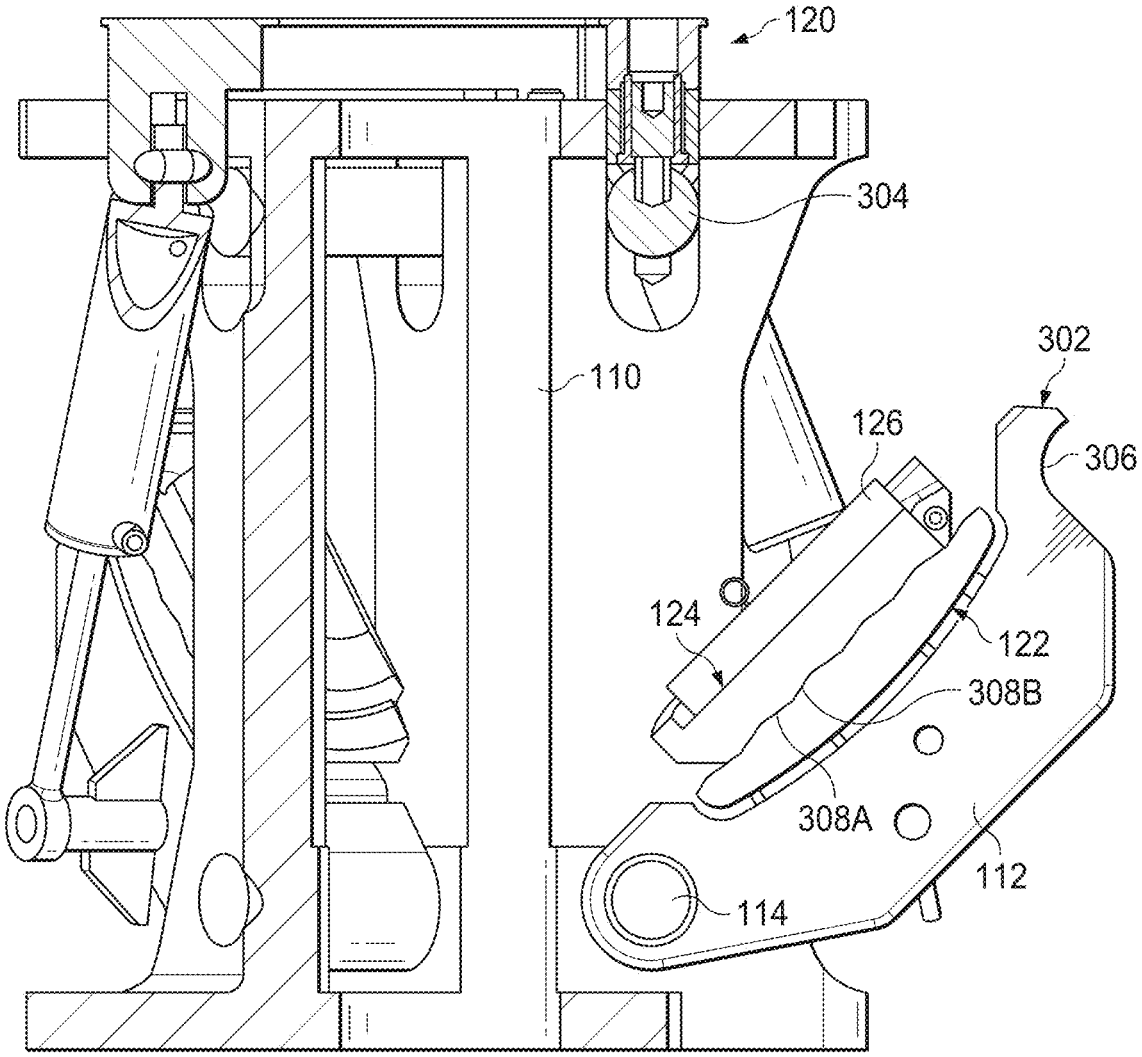
FIG. 3 illustrates a side view of the omnidirectional slip bowl of a pivot arm in an open position.

Referring now to FIG. 3, there is illustrated a cutaway side view of a pivot arm 112 in an open position. As mentioned previously, the first end of the pivot arm 112 is pivotally mounted to the central support frame 110 on a pin 114. The pivot arm 112 rotates between the open position illustrated in FIG. 3 to the closed position (FIG. 4) wherein a hook member 302 located on the second end of the pivot arm 112 opposite the first end of the pivot arm engages the cylinder mount 120. The hook member 302 defines a seat for a latching bar 304 associated with the cylinder mount 120. When the pivot arm 112 is moved to the closed position, the latching bar 304 rests within the locking face 306 of the hook member 302. As will be more fully described hereinbelow, when the slip bowl 102 is engaging a tubular with the pivot arms 112, the hook member 302 remains firmly engaged with the latching bar 304 and prevents the pivot arm 112 from pivoting from the closed position to the open position.

Figure 4:
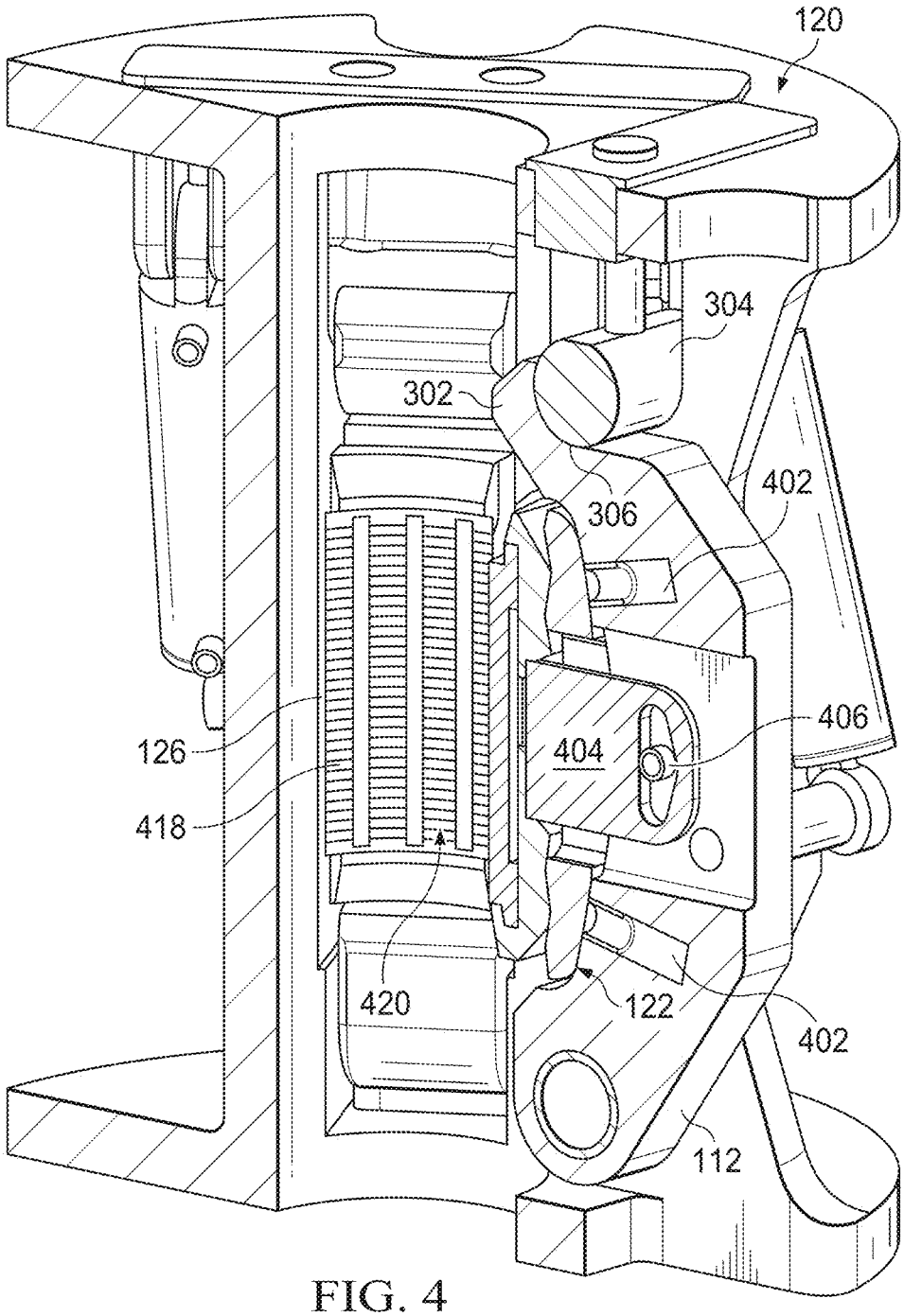
FIG. 4 illustrates a perspective view of a pivot arm in a closed position.

Referring now also to FIG. 4, a retaining arm 404 extends from the back of the carrier 124. The retaining arm 404 base inserts into a slot defined by the slide plate 122 and the pivot arm 112 and is held in place by a retaining pin 406. The retaining arm 404 enables the carrier 124 and the slide plate 122 to be held against biasing springs within the biasing spring chambers 402.

The slip plate 122 comprises an elongated member having a first side (i.e., outer face) thereof having an arcuate shape that engages with a similar arcuate shape on an interior face of the pivot arm 112. The curved shape of the outer face of the slide plate 122 and the corresponding curved shape of the inner face of the pivot arm 112 enable the slide plate to move up and down along the pivot arm 112. The arcuate shape of the slip plate 122 allows the carrier 124 to self-adjust and remain parallel to the centerline of the tubular in the wellbore. If for instance, the tubular was significantly undersized or the gripping insert worn and dull, the pivot arms 112 would travel further than nominal towards the centerline of the tubular before the insert would meet the tubular. Without the circular surface the gripping insert 126 would only contact the tubular at the insert's top edge. The circular sliding surface of the slip plate 122 allows the carrier 124 to shift with respect to the pivot arm 112 and align with the surface/centerline of the tubular. As the pivot arm 112 pivots closer to the centerline of the tubular, the slip plate 122 will remain parallel to the centerline tubular and drop down closer to the pivot of the pivot arm as it slides along the circular surface. The slip bowl cylinders 116 will position the pivot arms 112 until the gripping inserts 126 contact the tubular and the pre-load springs have been fully compressed. Then as the slip bowl is loaded, the angles on the second surface of the slip plate 122 will force the pivot arm 112 out until the hook 302 rests against the locking bar 304.

A second side (i.e., inner face) of the slide plate 122 defines a series of alternating angled surfaces 308 that are angled in a first direction 308A or a second direction 308B. By providing the alternating angled surfaces 308, the slide plate 122 allows movement of the carrier 124 and gripping insert 126 to enable the gripping insert to grip and hold a section of tubular in both of out-hole and in-hole directions. In this manner, the same group of pivot arms 112 and a single slip bowl 102 can prevent the tubular from moving in either direction in or out of the wellbore.

Referring now to FIG. 4, there is illustrated a cross-sectional perspective view through the center of the pivot arm 112. The cross-sectional view illustrates the pivot arm 112 in the locked position with respect to the latching bar 304 of the cylinder mount 120. The latching bar 304 is secured to the locking face 306 of the hook member 302. The pivot arm 112 further defines a pair of slide plate biasing chambers 402 into which preload springs are inserted for biasing the slide plate 122 outward from the pivot arm 112.

FIG. 4 also more particularly illustrates the pipe teeth 418 of the gripping inserts 126. Each of the gripping inserts 126 have a curved inner face 420 that is similar to the surface of a tubular to be gripped by the omnidirectional slip bowl 102. The curved outer face 420 includes a plurality of teeth therein that enable frictional engagement between the gripping insert 126 and a tubular. The gripping inserts 126 are made of material with a hardness value equal to or greater than the tubular to be gripped. The teeth 418 may also comprise a replaceable insert that may be periodically replaced as the teeth 418 wear down from repeated use. The gripping inserts 126 may comprise teeth, a grit face or even a smooth face depending on the application. The pipe inserts are selected based on the type and size of tubular being gripped by the slip bowl.

Figure 5:
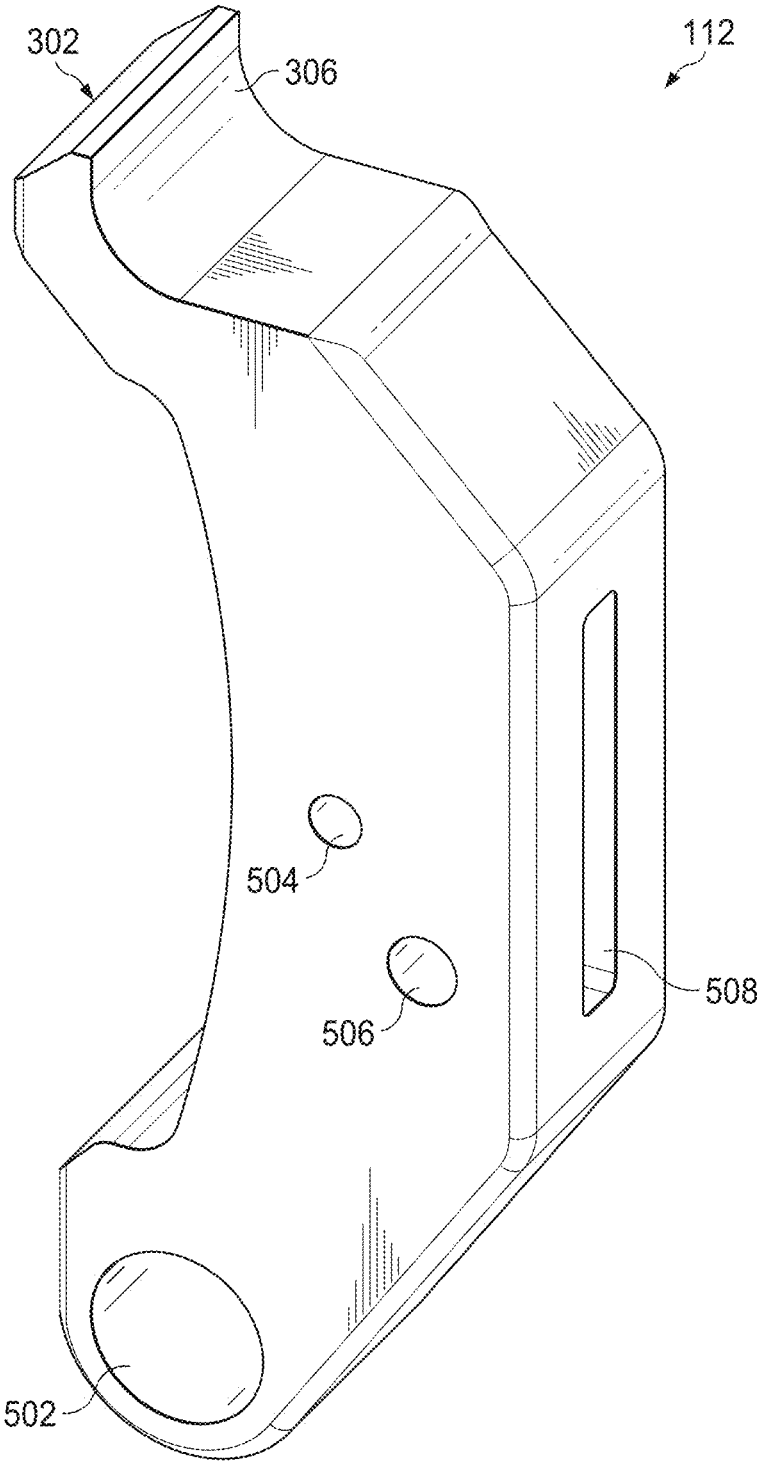
FIG. 5 illustrates a perspective view of the pivot arm.

FIG. 5 more particularly illustrates a perspective view of only the pivot arm 112. As discussed previously, a first end of the pivot arm 112 defines an opening 502 for receiving a pin 114 that is inserted through the pivot arm and the central support frame 110 to enable the pivot arm 112 to pivot between the open position and a closed position. The pivot arm 112 further defines a retainer clip opening 504 through which retaining pin 406 may be inserted to secure the retaining arm 404 that secures the carrier 124 and the slide plate 122 to the pivot arm 112. A further opening 506 is defined on each side of the pivot arm 112 for receiving a pin (i.e., through the support 118) to secure the hydraulic cylinder 116 to the pivot arm 112 to enable movement between the open position and a closed position as described hereinabove. The second end of the pivot arm 112 includes the hook member 302 for securing to the latching bar 304 of the cylinder mount 120. The cylinder mount engages with locking face 306 to maintain the pivot arm 112 in the closed position when a tubular is being gripped by the slip bowl 102. The pivot arm 112 further includes a retaining slot 508 for receiving the retaining arm 404. The retaining arm 404 inserts through a slot in the slide plate 122 in order to maintain the slide plate against the biasing springs inserted into the biasing chambers 402.

Figure 6:
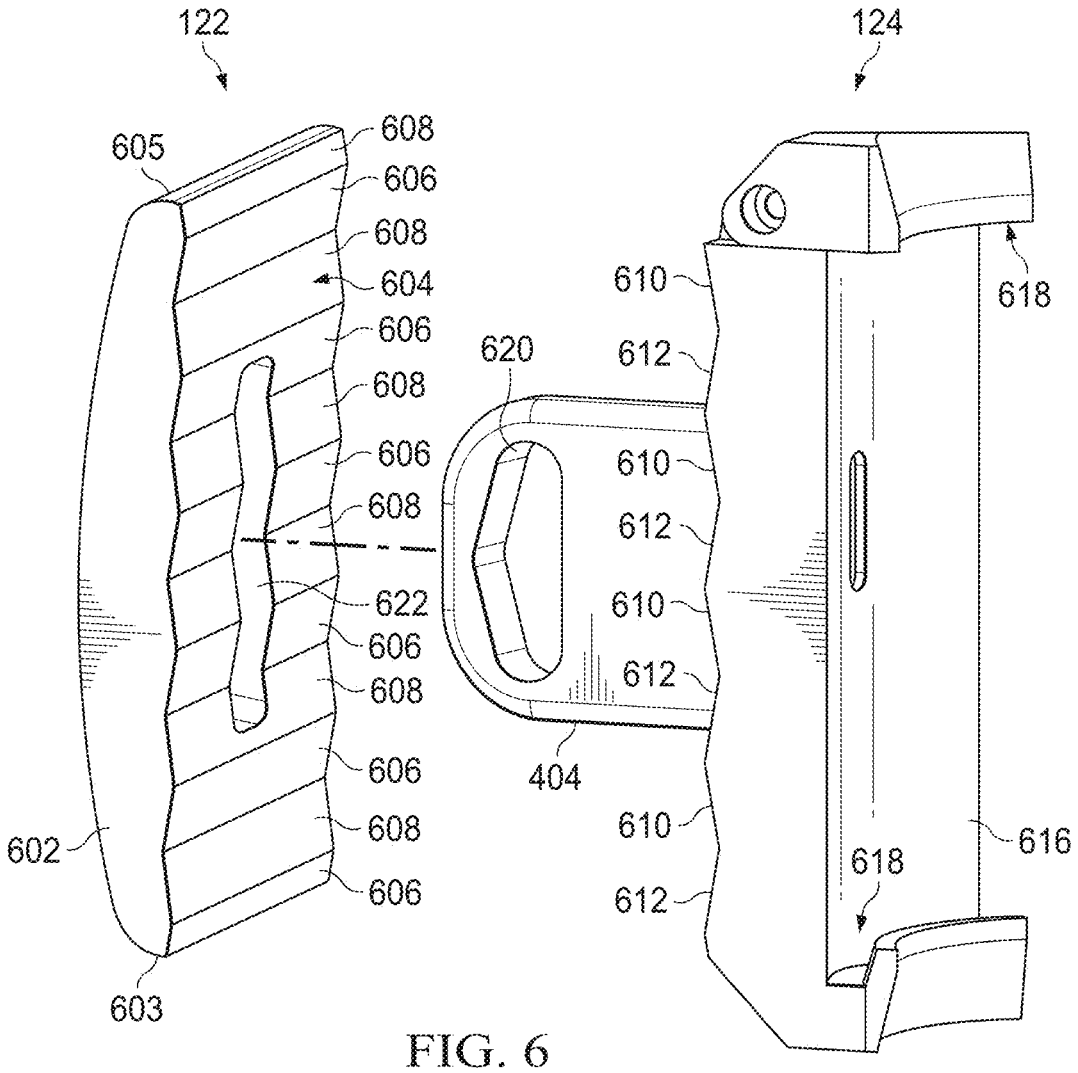
FIG. 6 illustrates a perspective view of the slide plate and carrier assemblies.

Referring now to FIG. 6, there is illustrated a perspective view of the slide plate 122 and the carrier 124. The slide plate 122 has a slight arcuate shape from a first end 603 to a second end 605 thereof. An outer face 602 of the slide plate 122, which rests against the pivot arm 112 defines a smooth arc from the first end 603 to the second end 605. An inner face 604 of the slide plate 122 includes a series of oppositely angled surfaces 606 and 608 to create a series of peaks and valleys on the inner face. A first portion 606 of the surfaces are angled in a first direction while a second portion 608 of the surfaces are angled in a second direction. The oppositely angled surfaces enable the slide plate 122 to configure the slip bowl to engage and grip the tubular that is either pushed down into a wellbore or pulled out of the well bore. When the slip bowl 102 is gripping a tubular within the slip bowl and the weight of the tubular is pulling the pipe down into the wellbore, the second angled faces 608 of the slip plate 122 are wedgingly engaged with adjoining faces of the carrier 124. In this pipe-heavy situation, the greater the downward movement of the carrier 124 relative to the slide plate 122, the greater the lateral wedging force produced between the second angled faces 608 of the slide plate 122 and the adjacent angled faces of the carrier 124. This wedging force pushes the carrier 124 and gripping insert 126 against the tubular while simultaneously pushing the slide plate 122 and pivot arm 112 away from the tubular. Similarly, when the slip bowl 102 is gripping a tubular that is being forced upward out of the wellbore, the first angled surfaces 606 of the slide plate 122 wedgingly engage adjoining angled surfaces on the carrier 124 to prevent movement of the tubular out of the slip bowl 102. In this pipe-light situation, the greater the upward movement of the carrier 124 relative to the slide plate 122, the greater the lateral wedging force produced between the first angled faces 606 of the slide plate 122 and the adjacent angled faces of the carrier 124.

As further described herein, when the slip 102 is gripping the tubular in either a pipe-heavy or pipe-light configuration, the outward lateral force on the pivot arm 112 caused by the wedging action between the slide plate 122 and carrier 124 is transmitted up the pivot arm to the hook member 302, causing the hook member to likewise exert an outward lateral force against the latching bar 304. The greater the wedging force on the pivot bar 112, the greater the locking force between the hook member 302 and the latching bar 304, regardless of whether the load is from a pipe-heavy or pipe-light situation. This interlocking relationship helps ensure the latching bar 304 cannot disengage from the hook member 302 and open the slip 102 when a significant load is present.

The carrier 124 includes on an outer face 609 thereof a series of oppositely angled surfaces 610 and 612. A first portion of the surfaces are angled in a first direction while a second portion 612 of the surfaces are angled in a second direction to provide a series of peaks and valleys and, when in an unloaded configuration, where the peaks of the carrier plate substantially align with the valleys of the slide plate 122 and the valleys of the carrier substantially align with the peaks of the slide plate. The oppositely angled surfaces enable the carrier 124 to configure the slip bowl 102 to engage and grip a tubular that is either being pushed down into a wellbore or pulled out of the wellbore. When the slip bowl 102 is gripping a tubular within the slip bowl and the weight of the string is pulling the pipe down into the wellbore, the first angled faces 610 of the carrier 124 are wedgingly engaged with an adjoining angled faces 608 of the slide plate 122. Similarly, when the slip bowl 102 is gripping tubular that is being forced upward out of the wellbore, the second angled surfaces 612 of the carrier 124 wedgingly engage adjoining angled surfaces 610 on the slide plate 122 to prevent movement of the tubular out of the slip bowl. The inner surface 616 of the carrier 124 includes slots 618 for receiving the gripping inserts 126 that directly engage the tubular and a pivoting member 128 to secure a gripping insert 126 into the carrier 124. The carrier 124 has extended perpendicularly from the back thereof a retaining arm 404 defining an opening 620 therein that is inserted through a slot 622 defined within the slide plate 122. As described hereinabove, when the retaining arm 404 is inserted through the slot 622 of the slide plate 122 and further through a corresponding slot 508 within the pivot arm 112, a pin may be used to insert through the pivot arm and the opening 620 to retain the carrier 124 and slide plate 122 against the pivot arm 112.

In some embodiments, the wedging surfaces on the slide plate 122 and carrier 124 each comprise at least one set of first and second flat surfaces, where each respective first flat surface is angled at a constant positive slope and each respective second flat surface is angled at a constant negative slope (with the slopes being measured relative to a median line on the respective wedging surface). In some such embodiments, multiple sets of first and second flat surfaces are arranged consecutively along the wedging surfaces (also known as "sawtooth" profile). For example, in the embodiment of FIG. 6, the wedging surfaces on the slide plate 122 and carrier 124 each comprise at least four adjacent sets of first and second flat surfaces arranged consecutively, where each respective first flat surface is angled at a constant positive slope and each respective second flat surface is angled at a constant negative slope. In other embodiments, the wedging surfaces on the slide plate 122 and carrier 124 each comprise a continuously curving surface having at least a first curved region of positive slope and a second curved region of negative slope. In some such embodiments, the wedging surfaces on the slide plate 122 and carrier 124 each comprise a continuously curving surface having multiple alternating portions of positive slope and negative slope. In some such embodiments, the wedging surfaces on the slide plate 122 and carrier 124 each comprise a repeating sine curve having multiple alternating portions of positive slope and negative slope. In still further embodiments, the wedging surfaces on the slip plate 122 and carrier 124 comprise other profiles that, when placed in contact with one another and moved relative to one another along a travel line, cause wedging engagement with one another producing a lateral force between the wedging surfaces, wherein the direction of the lateral force is the same when the direction of movement along the travel line is positive or negative.

Figure 7:
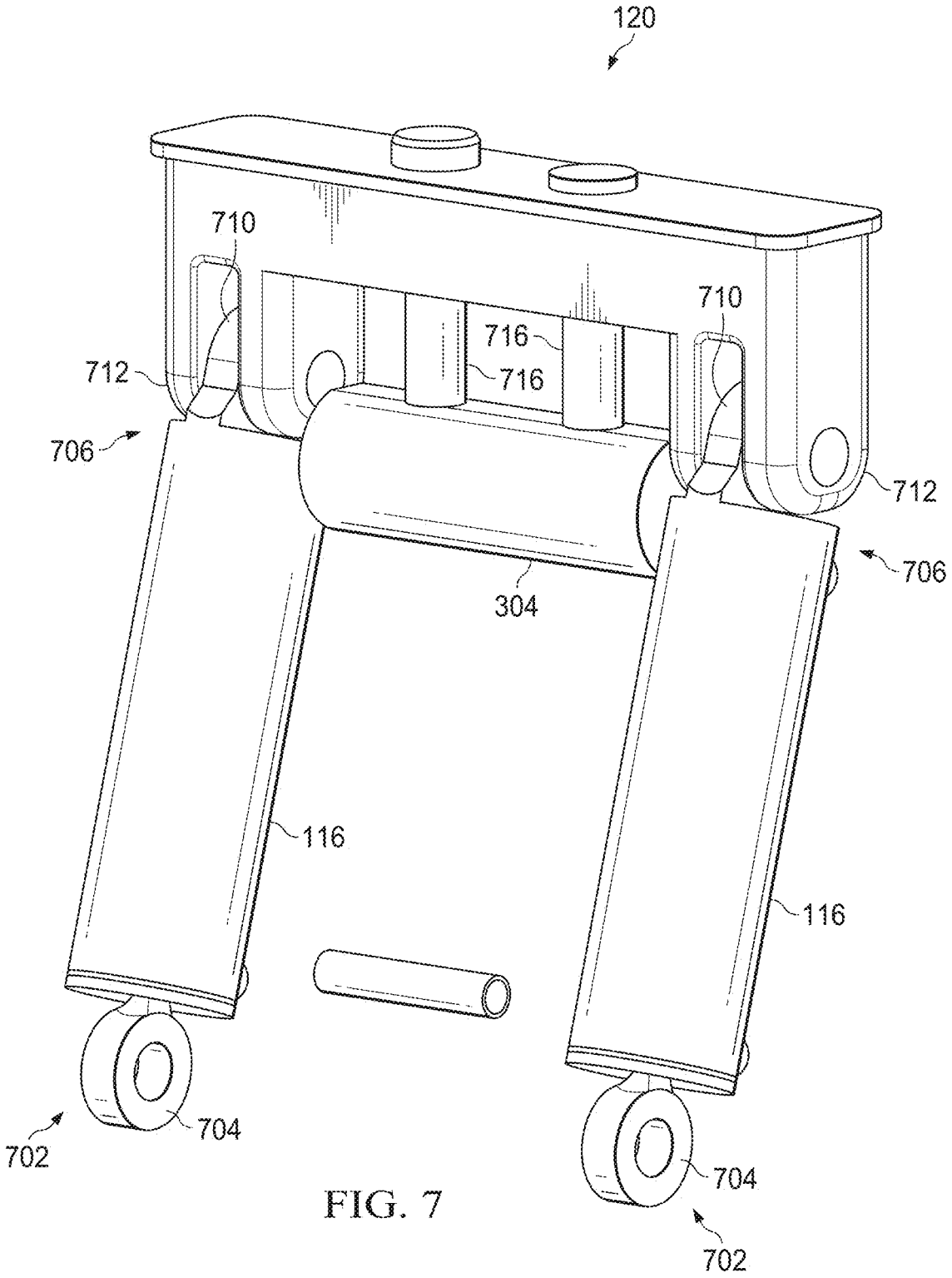
FIG. 7 illustrates a perspective view of the carrier mount.

Referring now to FIG. 7, there is illustrated the cylinder mount 120. The cylinder mount 120 includes a pair of hydraulic cylinders 116. The cylinders include a first end 702 defining a piston arm connector 704 that interconnect with the pivot arms 112. The second end 706 of the hydraulic cylinder 116 connects with the cylinder mount 120 at a flange 710 that inserts into a U-shaped connector 712 that extends downward from the cylinder mount 120. The cylinder mount 120 comprises a substantially rectangularly shaped member from which the U-shaped connectors hang downward to engage the hydraulic cylinders 116. A pin is inserted through the U-shaped connector 712 and the flange 710 in order to interconnect the hydraulic cylinder 116 to the cylinder mount 120. The locking bar 304 extends downward from the cylinder mount 120 from a pair of cylindrical members 716. The cylindrical members 716 extend downward from the cylinder mount 120 to maintain the locking bar 304 a fixed distance below the rectangular structure of the cylinder mount 120. The cylindrical members 716 are spring biased using nitrogen gas springs in one embodiment but other biasing mechanisms may be used. The locking bar 304 when engaged by the hook 302 of the pivot arm 112 maintains the pivot arms in a locked position when the slip bowl is bearing a string weight as more particularly described in FIG. 8.

Figure 8:
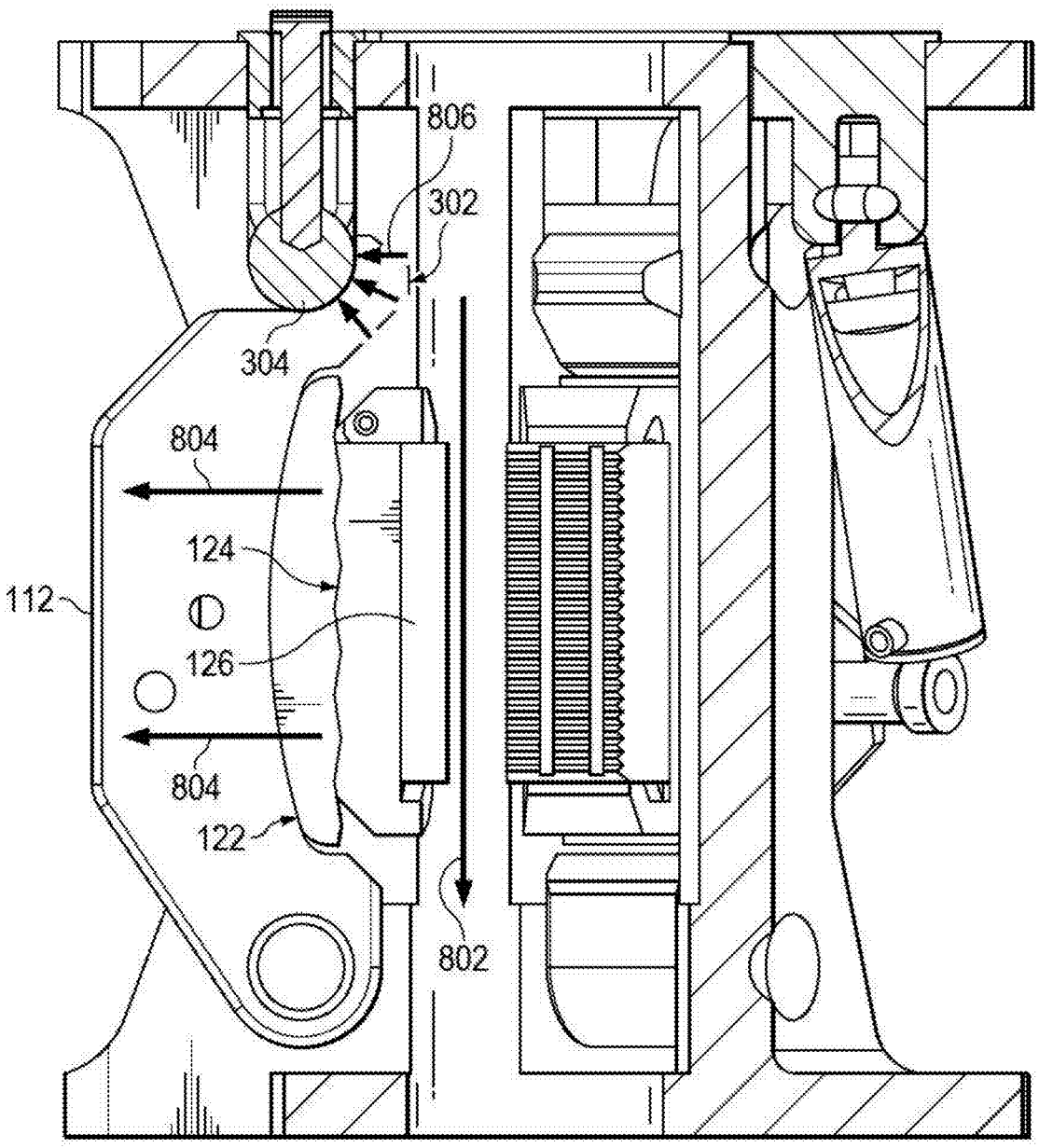
FIG. 8 illustrates the forces that lock a pivot arm to a locking bar responsive to tubular string weight.

When the pivot arms 112 are in a closed position and the slip bowl 102 supports a tubular from either falling into or pushing out of a wellbore, the cylinder mount 120 locks the pivot arms in the closed position. This is more particularly illustrated in FIG. 8. When a pivot arm 112 is in a closed position and the tubular (not shown) is engaged by the gripping inserts 126, the forces within the omnidirectional slip bowl 102 are as illustrated in FIG. 8.

Once there is tubular string weight held by the slip bowl 102, the tubular weight may in one embodiment provide a downward force in the direction shown by arrow 802. The downward force shown by arrow 802 of the tubular weight forces the carriers 124 to move downward relative to the slide plates 122 causing the adjoining angled surfaces to wedge against one another and produce an outward lateral force on the slide plates 122 shown by arrow 804. This causes the slide plate 122 to provide a lateral force on the pivot arms 112 in the direction illustrated by arrows 804. The lateral force shown by arrow 804 upon the pivot arm 112 also causes a lateral force between the hook 302 at the top of the pivot arm 112 and the latching bar 304 as illustrated generally by the arrows 806. The lateral force causes frictional forces between the hook 302 and latching bar 304 to help lock the latching bar in place and keep the cylinders 116 from being able to unlatch the pivot arms 112 when tubular weight is present in either direction.

Figure 9:
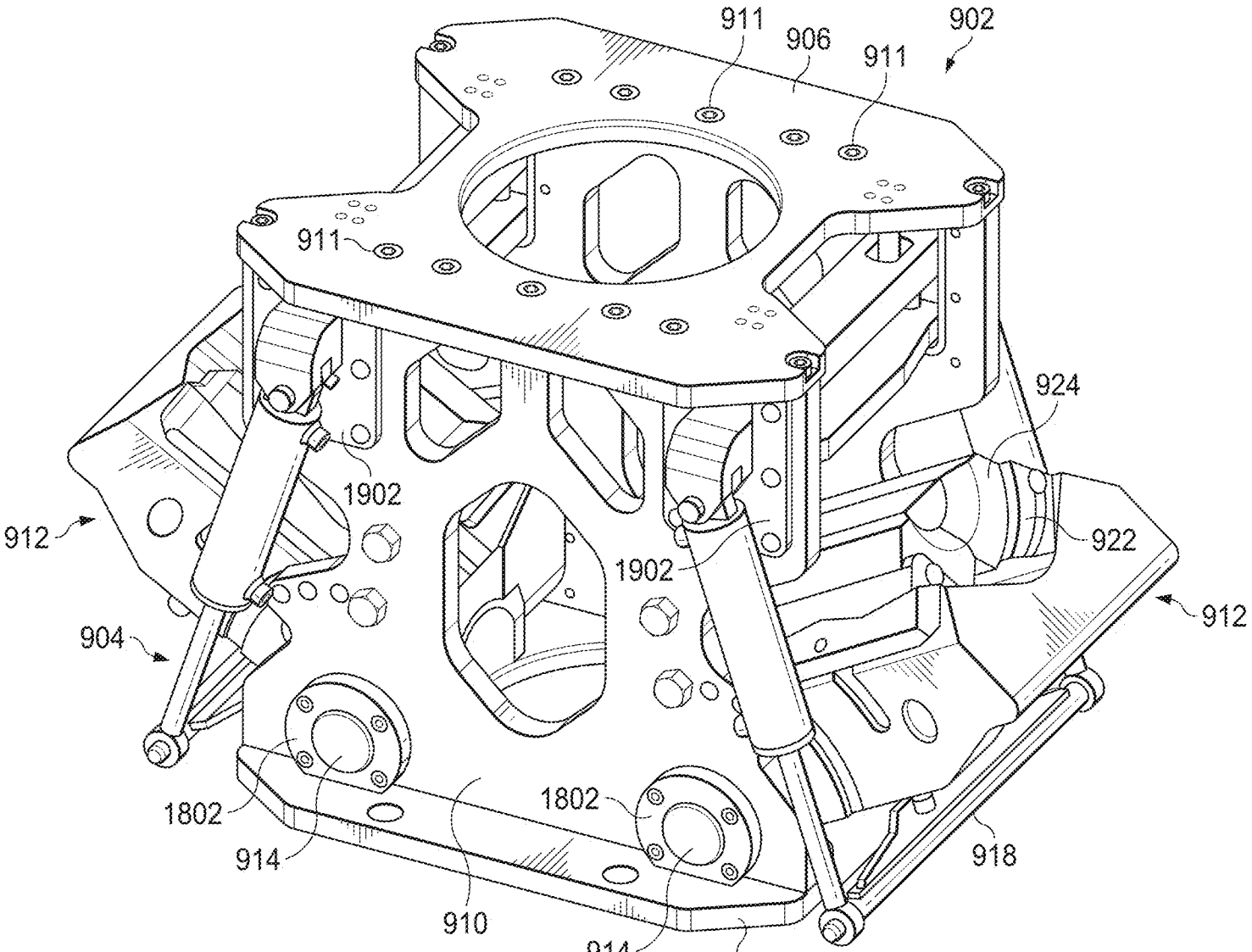
FIG. 9 illustrates a perspective view of an alternative embodiment of an omnidirectional slip bowl in a closed configuration.
Figure 10:
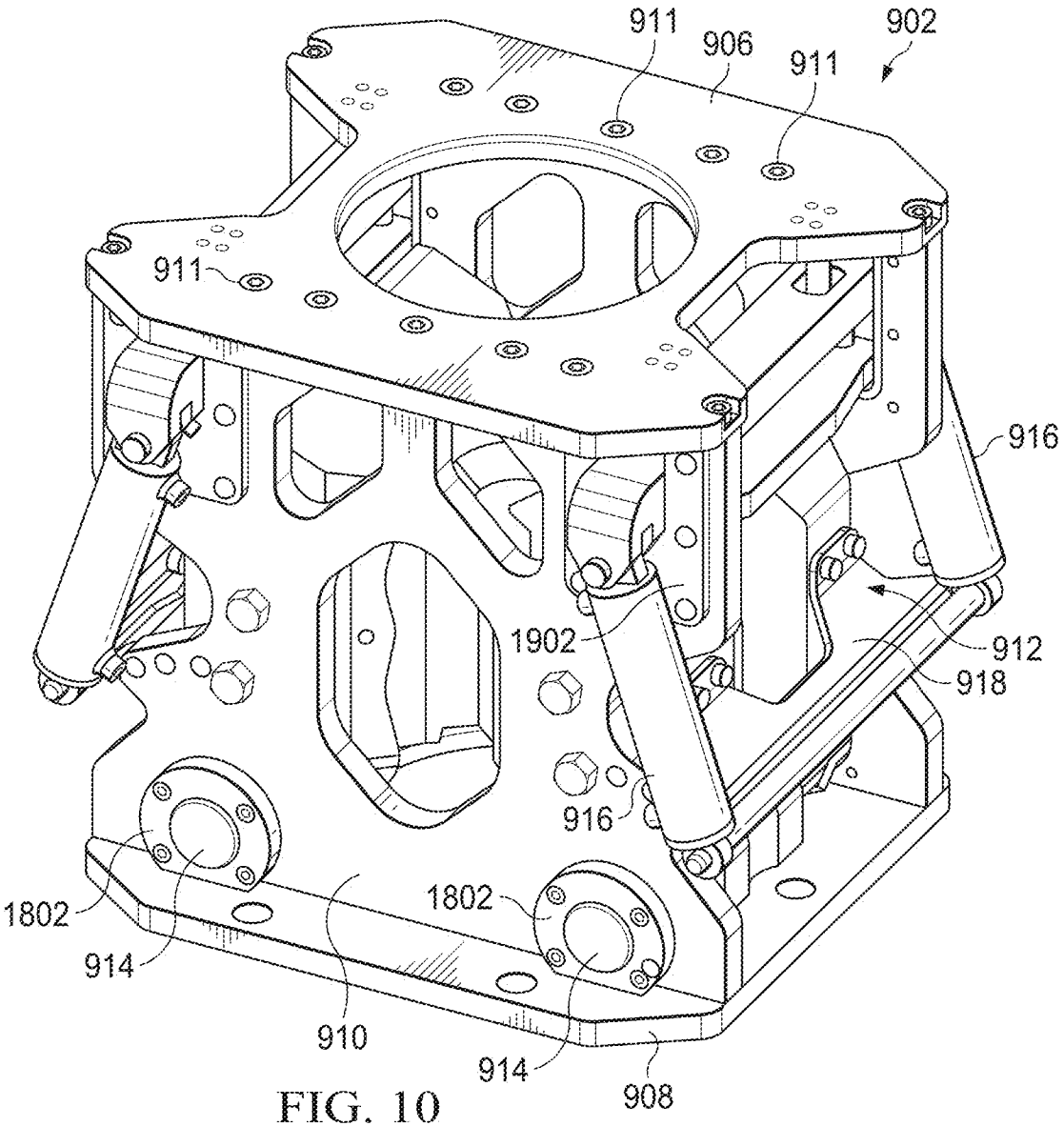
FIG. 10 illustrates a perspective view of the alternative embodiment of the omnidirectional slip bowl in an open configuration.

Referring now to the drawings, and more particularly to FIGS. 9 and 10, there are illustrated perspective views of an alternative embodiment of the omnidirectional slip bowl in both the closed configuration (FIG. 9) and open configuration (FIG. 10). The omnidirectional slip bowl 902 has a support frame 904 including a top plate 906 and a lower plate 908 that are interconnected by a central support frame 910. The top plate 906 and the lower plate 908 are connected to the central support frame 910 via series of bolts 911 that are inserted through the top plate 906 and lower plate 908 and threadedly engage holes in the central support frame 910. Alternatively, the top plate 906 and the lower plate 908 can be welded to the central support frame 910. The current embodiment illustrates an alternative support frame 904 from that described previously with respect to FIGS. 1 and 2. The top plate 906, the lower plate 908 and the central support frame 910 define a circular opening therein to enable tubulars to pass through the support frame 904. A pair of pivot arms 912 are pivotally connected to the central support frame 910 at respective pivot pins 914. The alternative embodiment of FIGS. 9 and 10 illustrate the use of a pair of pivot arms 912 within the slip bowl 902 that are each located on opposite sides of the slip bowl for gripping tubulars inserted within the slip bowl 902 in order to prevent the tubulars from moving within the slip bowl.

The pivot arms 912 pivot between an open position as illustrated in FIG. 9 and a closed position as illustrated in FIG. 10. Each pivot arm 912 is actuated between the closed position and the open position utilizing a pair of hydraulic cylinders 916. The hydraulic cylinders 916 pivotally interconnect at a first end to the pivot arm 912 at a bracket 918 and to an upper cylinder mount 920 at a second end of the hydraulic cylinder 916. The bracket 918 connects to the pivot arm 912 and moves the pivot arm between the open and closed positions. When in the closed position, the slip bowl 902 is capable and rated for transmitting rotational torque loads to tubulars gripped by the slip bowl.

The pivot arm 912 has mounted thereon a pair of slip plates 922. Rather than containing a single slide plate/carrier/insert assembly like the embodiment of FIGS. 1 and 2, the alternative embodiment provides two slide plate/carrier/insert assemblies in each pivot arm 912. When the slip bowl 902 is in the closed configuration, the slide plate 922 moves up and down along an interior face of the pivot arm 912 in order to maintain engagement of the slip bowl 902 with the tubular located within the slip bowl 902. The slide plates 922 each engage an associated carrier 924 that moves up and down along the inner face of the pivot arm 912 in association with the slide plate 922. A gripping insert 926 is mounted within the carrier 924. The gripping insert 926 includes a surface, as more particularly described hereinabove, for engaging the surface of the pipe, tubular or casing that is inserted within the slip bowl 902. The gripping insert 926 prevents the tubular from moving perpendicularly with respect to the central axis of the support frame 904 when gripping the tubular.

Figure 11:
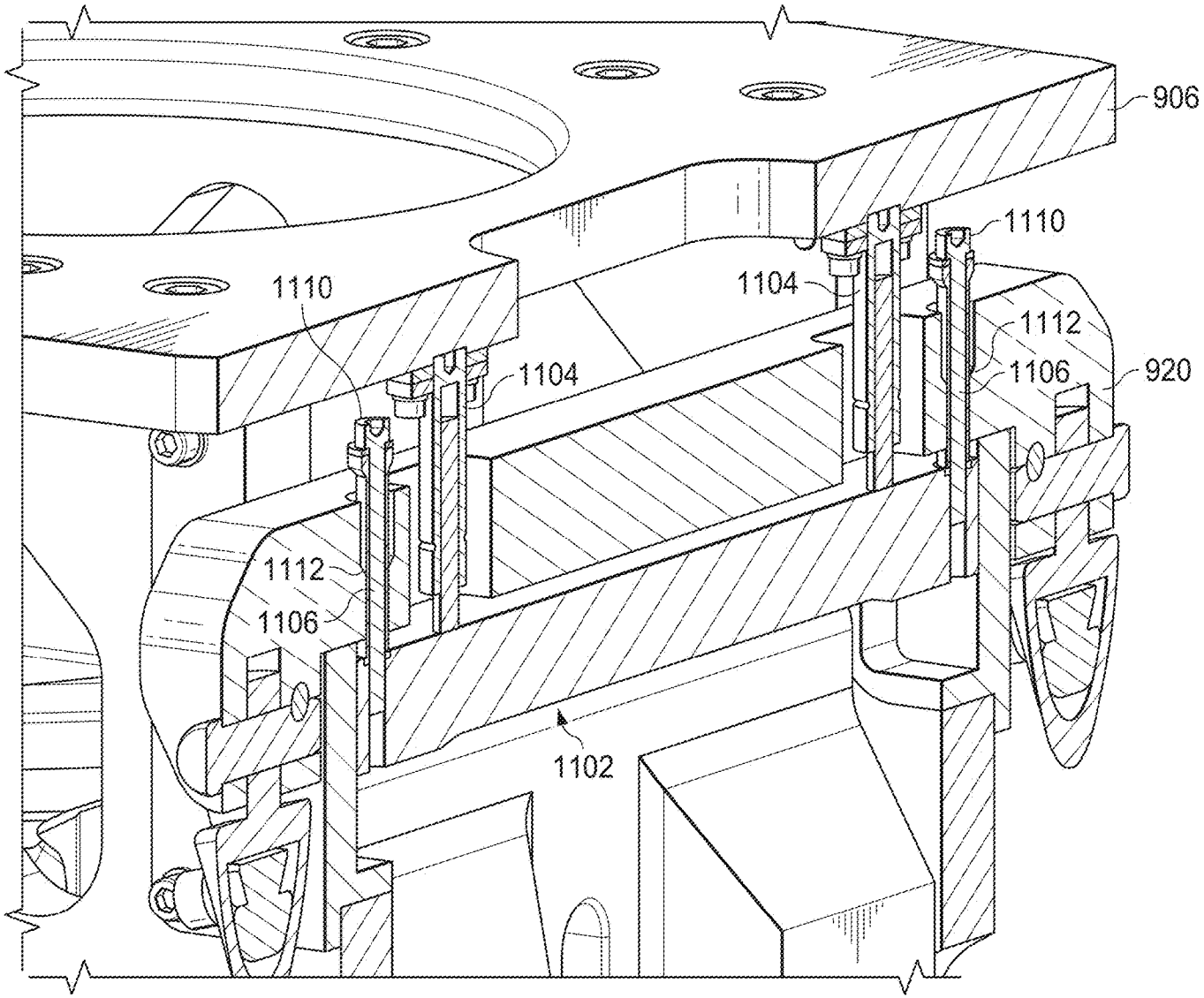
FIG. 11 illustrates a cutaway view of the interconnection of the upper cylinder mount and the locking bar in the closed configuration.
Figure 12:
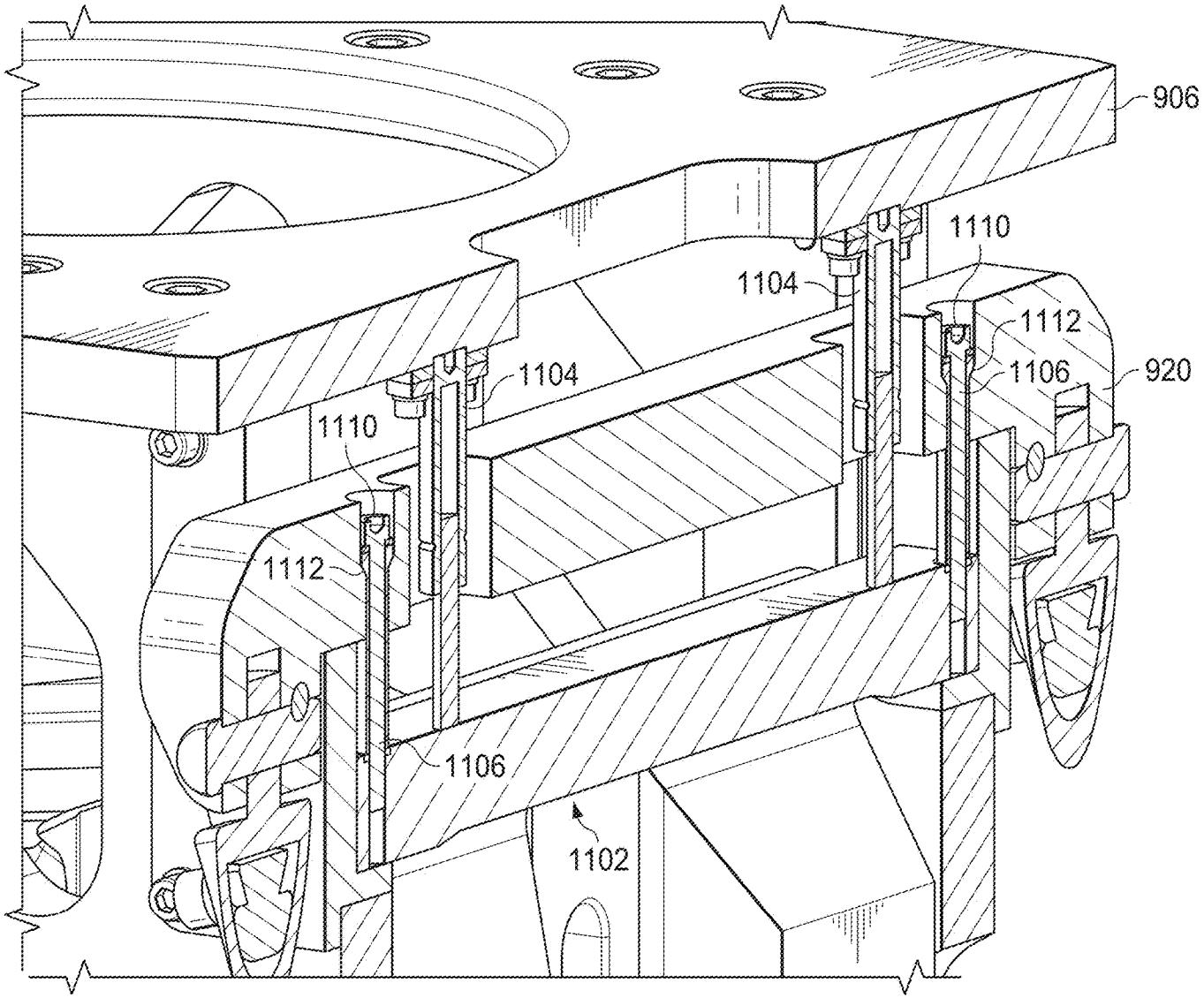
FIG. 12 illustrates a cutaway view of the interconnection of the upper cylinder mount and the locking bar in the open configuration.

Referring now to FIGS. 11 and 12, there is illustrated an alternative embodiment for interconnecting the latching bar 1102 and the upper cylinder mount 920. FIG. 11 illustrates the latching bar 1102 and the upper cylinder mount 920 in the closed position for the pivot arms 912 and FIG. 12 illustrates the latching bar 1102 and the upper cylinder mount 920 in the open position for the pivot arms 912. A pair of nitrogen springs 1104 connect the latch bar 1102 to the top plate 906. The top end of the nitrogen springs 1104 are bolted to the bottom surface of the top plate 906. The bottom end of the nitrogen springs 1104 is fixed to the latch bar 1102. The nitrogen springs 1104 are biased to push the latch bar 1102 away from the top plate 906. The nitrogen springs 1104 keep the latch bar 1102 seated in place when the pivot arm 912 is in motion. The nitrogen springs 1104 also maintain the connection such that the upper cylinder mount 920 can lift the latch bar 1102 out of the way in order to disengage from the pivot arm 912 and enable pivot arms of the slip bowl 902 to open.

A pair of lift rods 1106 enable the upper cylinder mount 920 to lift the latch bar 1102 when the upper cylinder mount is raised by hydraulic cylinders 916. A lower threaded portion 1108 of the lift rods 1106 threadedly engage the latch bar 1102. An upper portion of the lift rods 1106 includes a head 1110 for engaging a ledge 1112 defined within the upper cylinder mount 920.

When the slip bowl 902 has the pivot arms in the closed position as shown in FIG. 11, the pivot arm 912 force the latch bar 1102 upward into the upper cylinder mount 920 and compress the nitrogen springs 1104 between the top plate 906 and the latch bar 1102. The upward movement of the latch bar 1102 forces the lift rods 1106 off of the ledge 1112 and forces the latch bar against the upper cylinder mount 920. When the slip bowl 902 has the pivot arms 912 in the open position as shown in FIG. 12, the nitrogen springs 1104 forces the latch bar 1102 downward. The downward movement of the latch bar 1102 pulls the lift rods 1106 lower causing the head 1110 to engage the upper cylinder mount 920 and pull the upper cylinder mount firmly against the latch bar.

Figure 13:
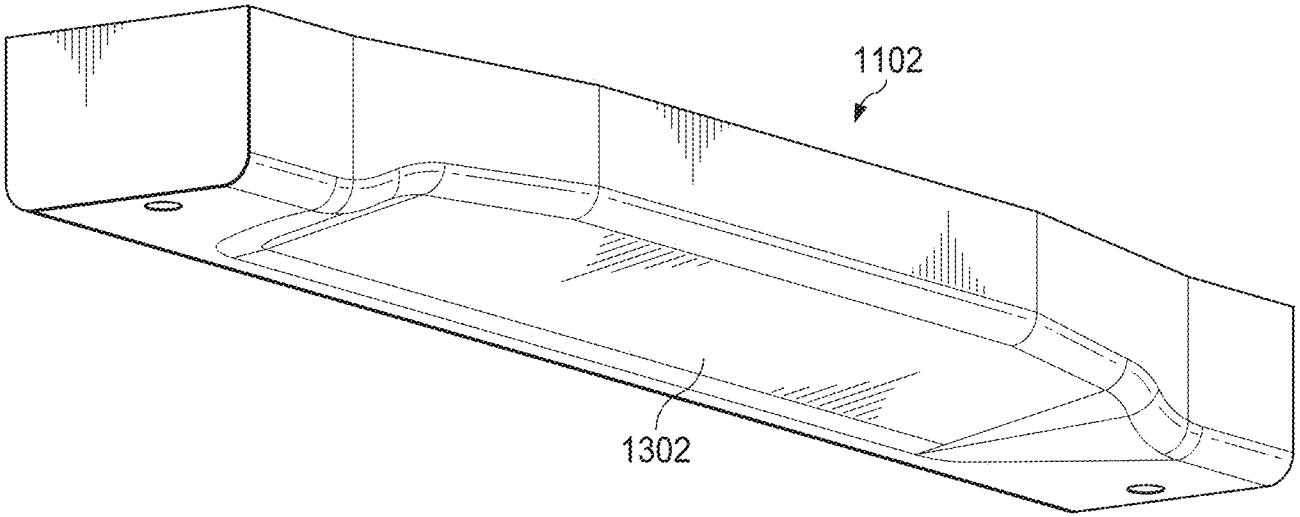
FIG. 13 illustrates a perspective view of the locking bar.

Referring now to FIG. 13 there is illustrated the new embodiment of the latch bar 1102. The latch bar 1102 has a rectangular shape rather than being round as described hereinabove with respect to FIGS. 1 and 2. The latch bar 1102 includes a ramp surface 1302 for better engaging the pivot arm 912.

Figure 14:
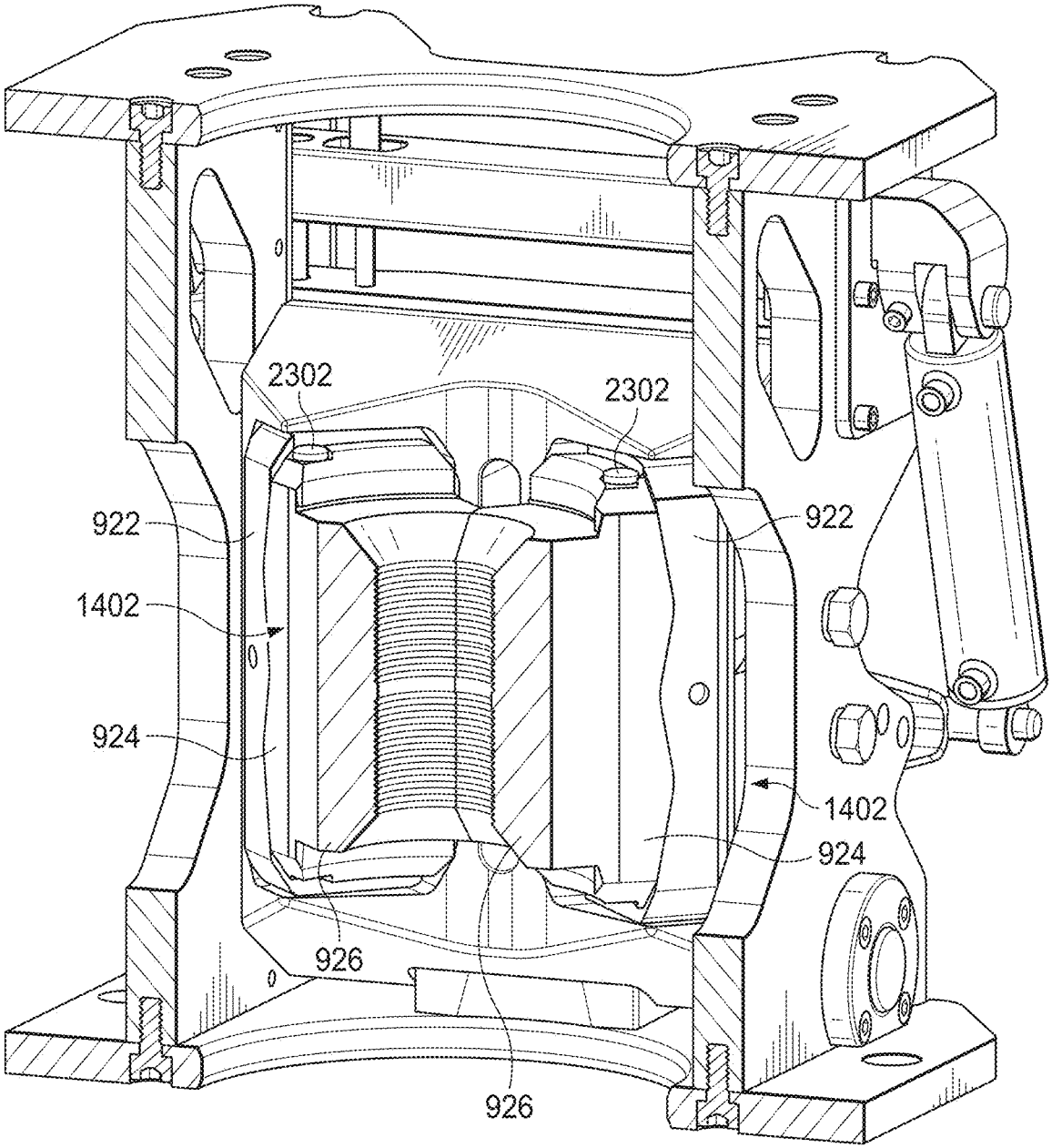
FIG. 14 illustrates the carrier/slide plate assemblies of the new embodiment.

Referring now to FIG. 14, there is illustrated a cutaway view showing the carrier/slide plate assemblies 1402 that are mounted within a pivot arm 912. As discussed previously with respect to FIGS. 1 and 2, only a single carrier/slide plate assembly was installed in each pivot arm. In the alternative embodiment illustrated in FIG. 14, a pair of carrier/slide plate assemblies 1402 are installed in each pivot arm 912 on opposite sides of the slip bowl 902. The carrier/slide plate assembly 1402 consists of a slide plate 922 that connects the carrier/slide plate assembly 1402 to the pivot arm 912. A carrier 924 is connected to the slide plate 922. The back surface of the carrier 924 and the front surface of the slide plate 922 have alternating angled surfaces in order to facilitate interfacing of the gripping inserts 926 with a tubular whether the tubular is being lowered within or raised from the wellbore. The front surface of the carrier 924 defines an area for receiving the gripping insert 926 which are secured in place via a retaining rod 2302 which will be more fully described herein below. The pair of gripping inserts 926 engage the surface of a tubular passing through the slip bowl 902.

Figure 15:
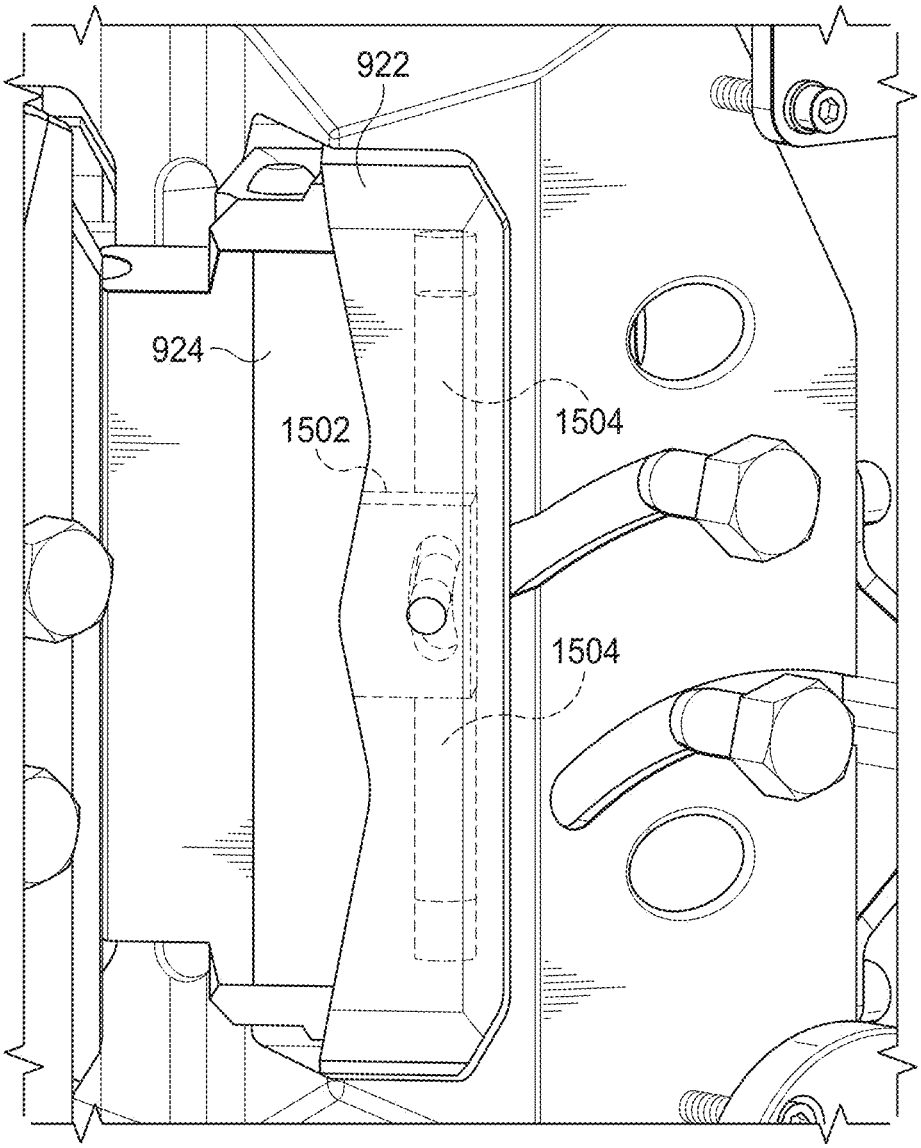
FIG. 15 illustrates the biasing springs for maintaining the carrier/slide plate assembly in a neutral position.

Referring now to FIG. 15, there is illustrated a side view of the new embodiment of the installation of the carrier plate 924 within the pivot arm 912. The slide plate 922 is maintained within the pivot arm 912 via a retaining tab 1502. The carrier/slide plate assembly 1402 are maintained in a substantially center position within the pivot arm 912 when no forces are being applied to the slip bowl 902 by a tubular. The substantially center position is maintained by a pair of biasing springs 1504. The biasing springs 1504 are placed above a retaining tab 1502 and below the retaining tab 1502 within the pivot arm 912 in order to maintain the substantially center position. The upper biasing spring 1504 forces the retaining tab 1502 and thus the entire carrier/slide plate assembly 1402 downward yet yields to upward forces from the tubular in order to allow the carrier/slide plate assembly to move upward within the pivot arm 912 responsive to the upward forces of the tubular. Similarly, the lower biasing spring 1504 forces the retaining tab 1502 and thus the entire carrier/slide plate assembly 1402 upward yet yields to downward forces from the tubular in order to allow the carrier/slide plate assembly to move downward within the pivot arm 912 responsive to the downward forces. The biasing forces applied by each of the biasing springs 1504 are substantially equal such that when no external forces are provided from a tubular within the slip bowl 902, the carrier/slide plate assembly 1402 will move to a substantially central position within the pivot arm 912.

Figure 16:
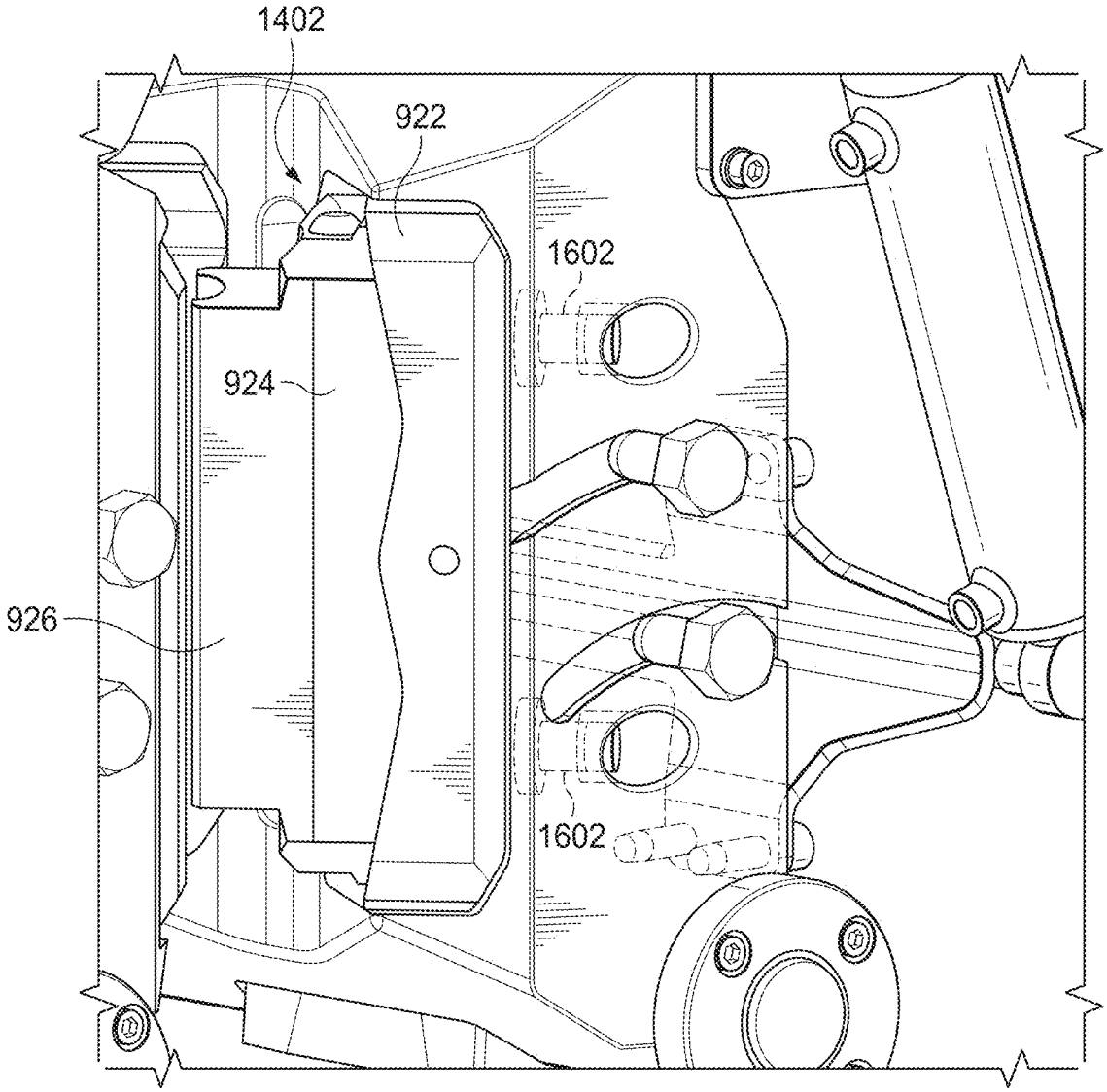
FIG. 16 illustrates the biasing springs for maintaining the carrier/slide plate assembly in contact with a tubular.

Referring now to FIG. 16, there is illustrated a side view of an additional new embodiment of the carrier/slide plate assembly 1402. The slide plate 922 of the carrier/slide plate assembly 1402 is spring loaded from the pivot arm 912 toward the center line of the slip bowl 902. A pair of springs 1602 are mounted within cavities defined within the pivot arm 912. The springs 1602 within the pivot arm 912 comprise Belville washers. The spring loading of the carrier/slide plate assembly 1402 enables the slip bowl 902 to accommodate oversized and undersized joints of various types within the allowed API tolerance. Thus, a drill pipe that was slightly larger or slightly smaller than normal pipe joints would still be able to be secured within the slip bowl 902 via the perpendicular movement provided to the carrier/slide plate assembly 1402 by the springs 1602.

Figure 17:
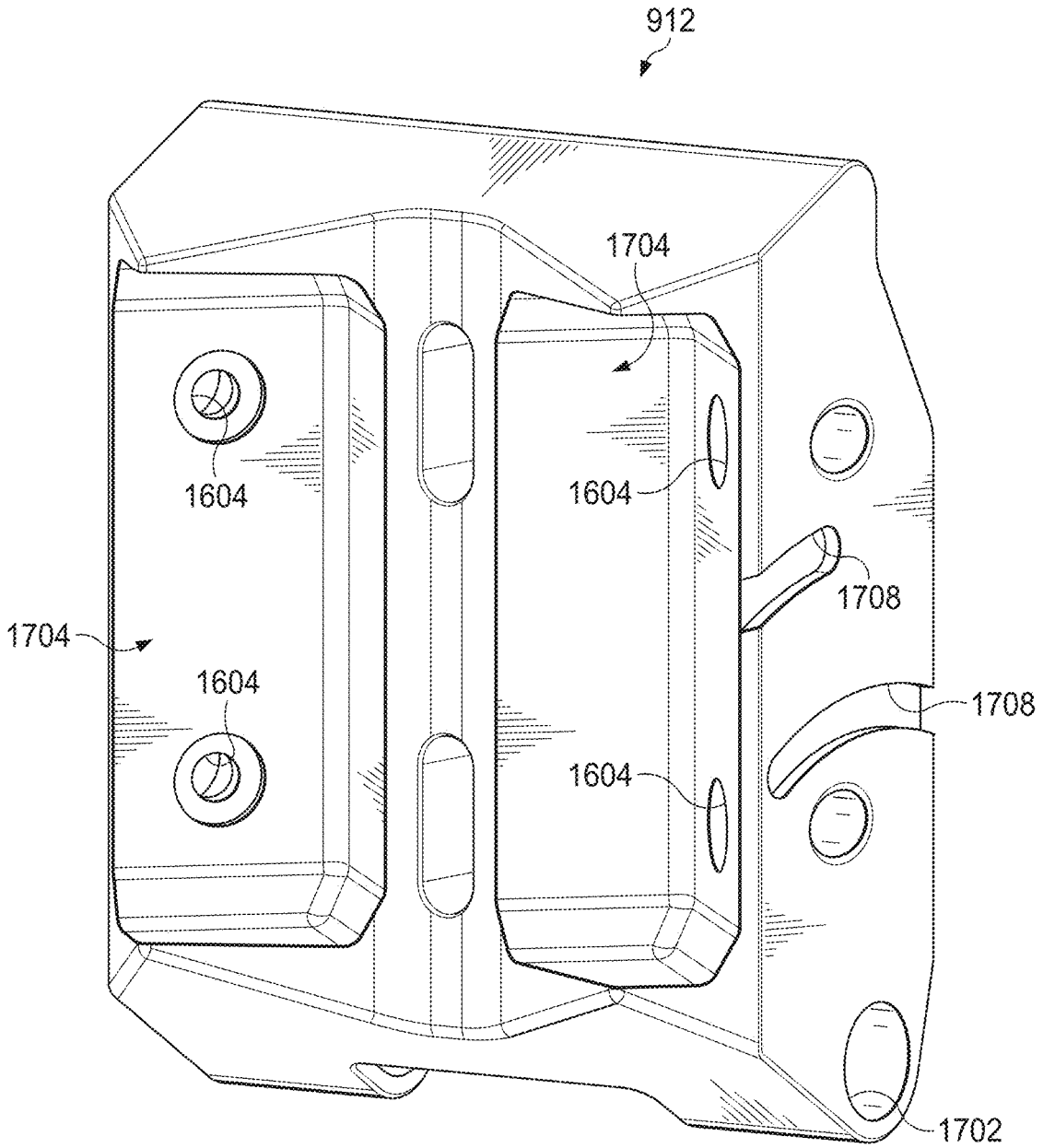
FIG. 17 illustrates a perspective view of the pivot arm.

Referring now to FIG. 17, there is illustrated a perspective view of the pivot arm 912. The pivot arm 912 defines a channel 1702 for receiving the pin 914 upon which the pivot arm 912 rotates. The pivot arm 912 also defines a pair of recesses 1704 for receiving the carrier/slide plate assemblies 1402. Additionally, cavities 1604 are defined along the back surfaces of the recesses 1704 to enable placement of the Belville washers comprising the springs 1602 discussed with respect to FIG. 16. The pivot arm 912 further defines stop channels 1708 on each side thereof which will be more fully discussed herein below to control the amount that the pivot arms will move when pivoting back and forth upon its pin 914.

Figure 18:
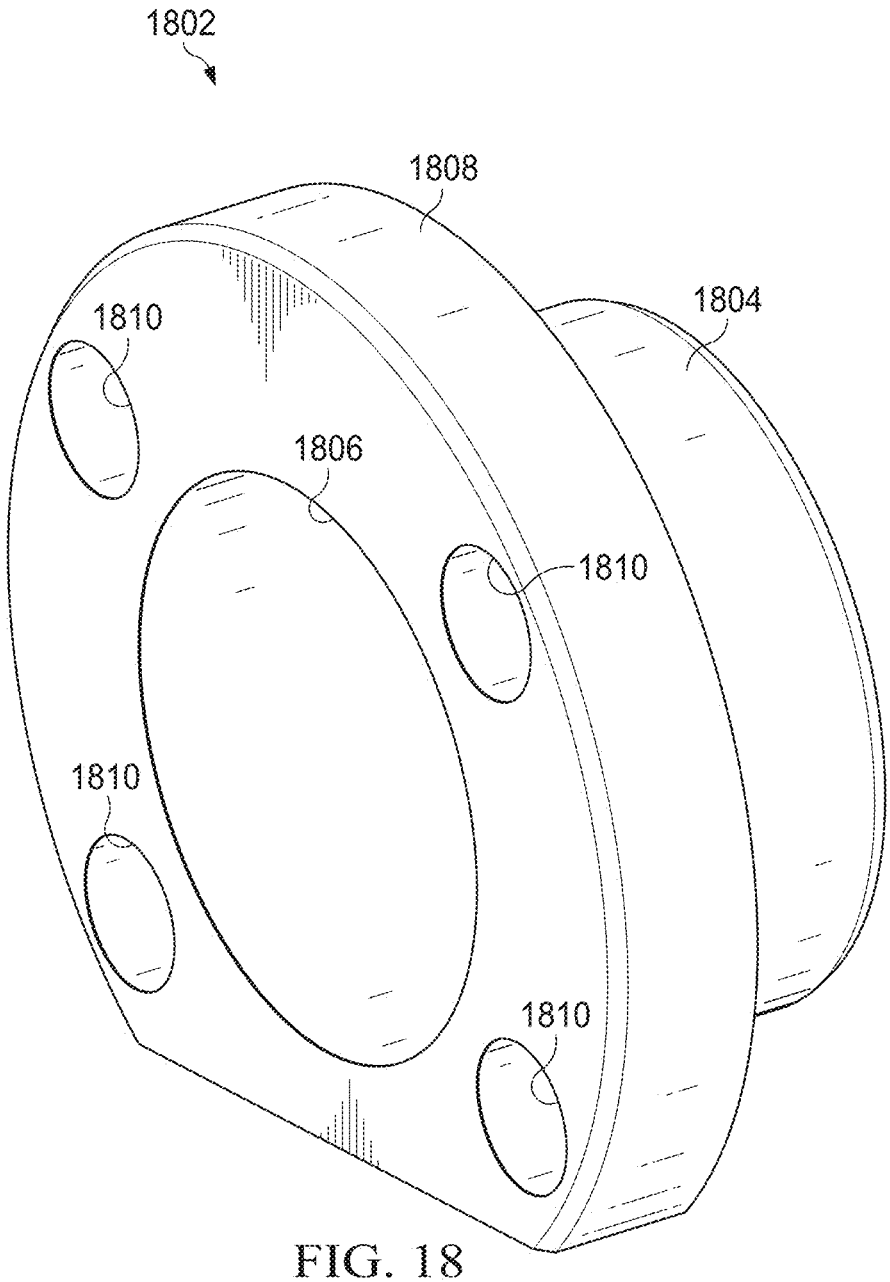
FIG. 18 illustrates a pivot arm wear insert.
Figure 19:
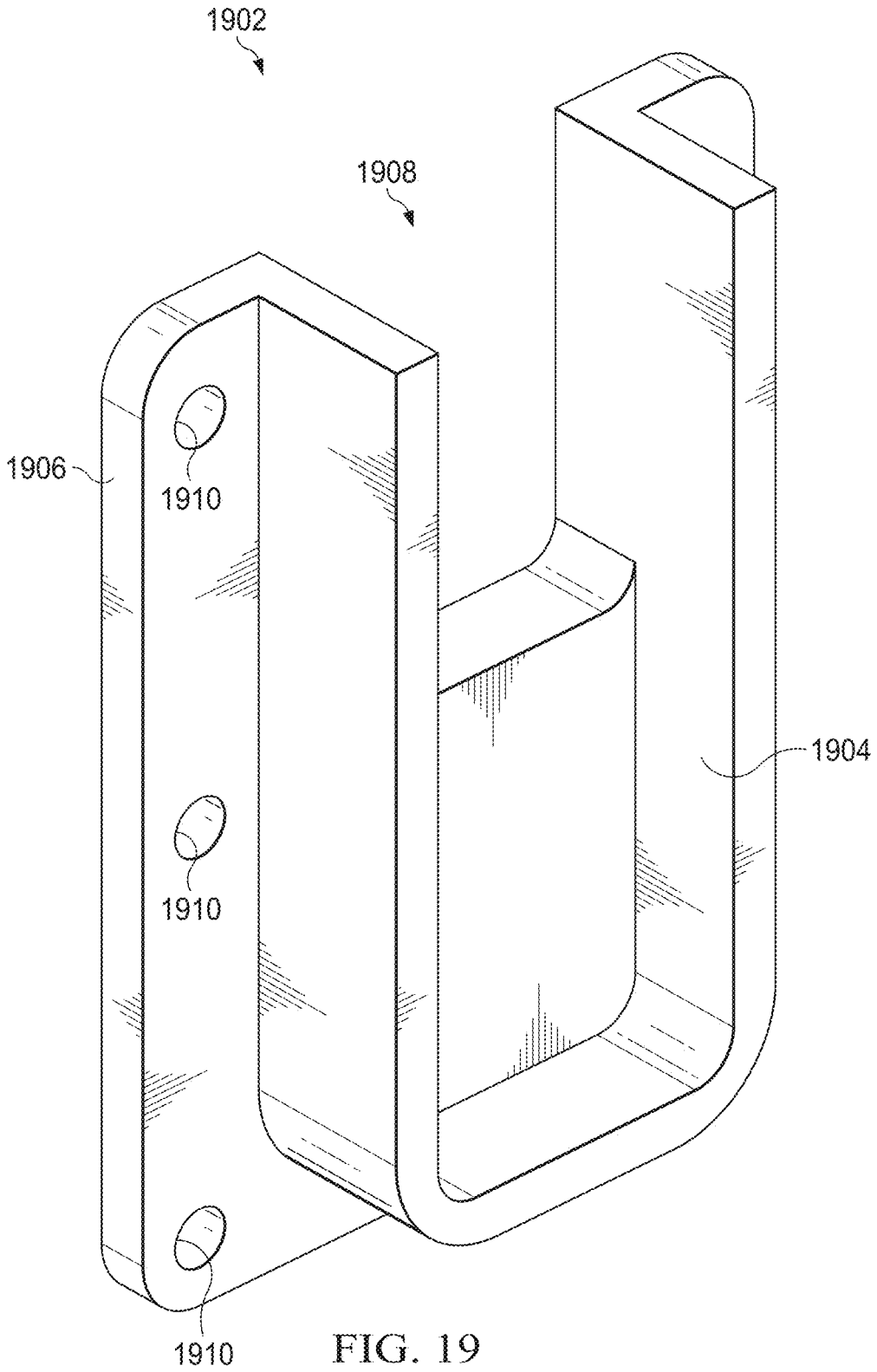
FIG. 19 illustrates an upper cylinder mount wear insert.

FIGS. 18 and 19 illustrate wear inserts for use with the slip bowl 902. There are certain points upon the central support frame 910 of the slip bowl 902 that will experience significant wear do to repeated movement of components against the central support frame. One way for addressing the wear issue to prevent the need for replacement or repair of the central support frame 910 is to utilize wear inserts. FIG. 18 illustrates a pivot pin wear insert 1802 that is inserted at locations on each side of the slip bowl 902 to receive the pivot pin 914 of the pivot arm 912. The insert 1802 includes a cylindrical body 1804 that is configured to be inserted within a receiving hole defined within the central support frame 910. The cylindrical body 1804 further defines an opening 1806 therein into which the pivot pin 914 is inserted. On one end of the cylindrical body 1804 is a flange 1808 that abuts against the side wall of the central support frame 910 such that the flange can be bolted to the central support frame through a series of bolt holes 1810. The position of the pivot pin wear insert 1802 is more particularly illustrated in FIGS. 9 and 10. The pivot pin wear insert 1802 may be removed and replaced when wear becomes an issue around the pivot pin 914 rather than being required to replace the entire portion of the central support frame 910 rubbing against the pivot pin 914.

Similarly, FIG. 19 illustrates an upper cylinder mount wear insert 1902 that is inserted at a location to receive the upper cylinder mount 920 and prevent wear of the central support frame 910. The upper cylinder mount wear insert 1902 includes a U-shaped portion 1904 that is configured to insert within a corresponding shape within the central support frame 910 and a flange 1906 connected to one side of the U-shaped portion 1904. The flange 1906 further defines a U-shaped channel 1908 in which the upper cylinder mount 1920 will move up and down responsive to the forces applied by the pair of cylinders 916. The flange 1906 further defines a series of bolt holes 1910 that are defined on each side of the flange to enable the upper cylinder mount wear insert 1902 to be bolted to the central support frame 910. The position of the cylinder mount wear insert 1902 is more particularly illustrated in FIGS. 9 and 10. The cylinder mount wear insert 1902 may be removed and replaced when wear becomes an issue rather than being required to replace the entire portion of the central support frame 910.

Figure 20:
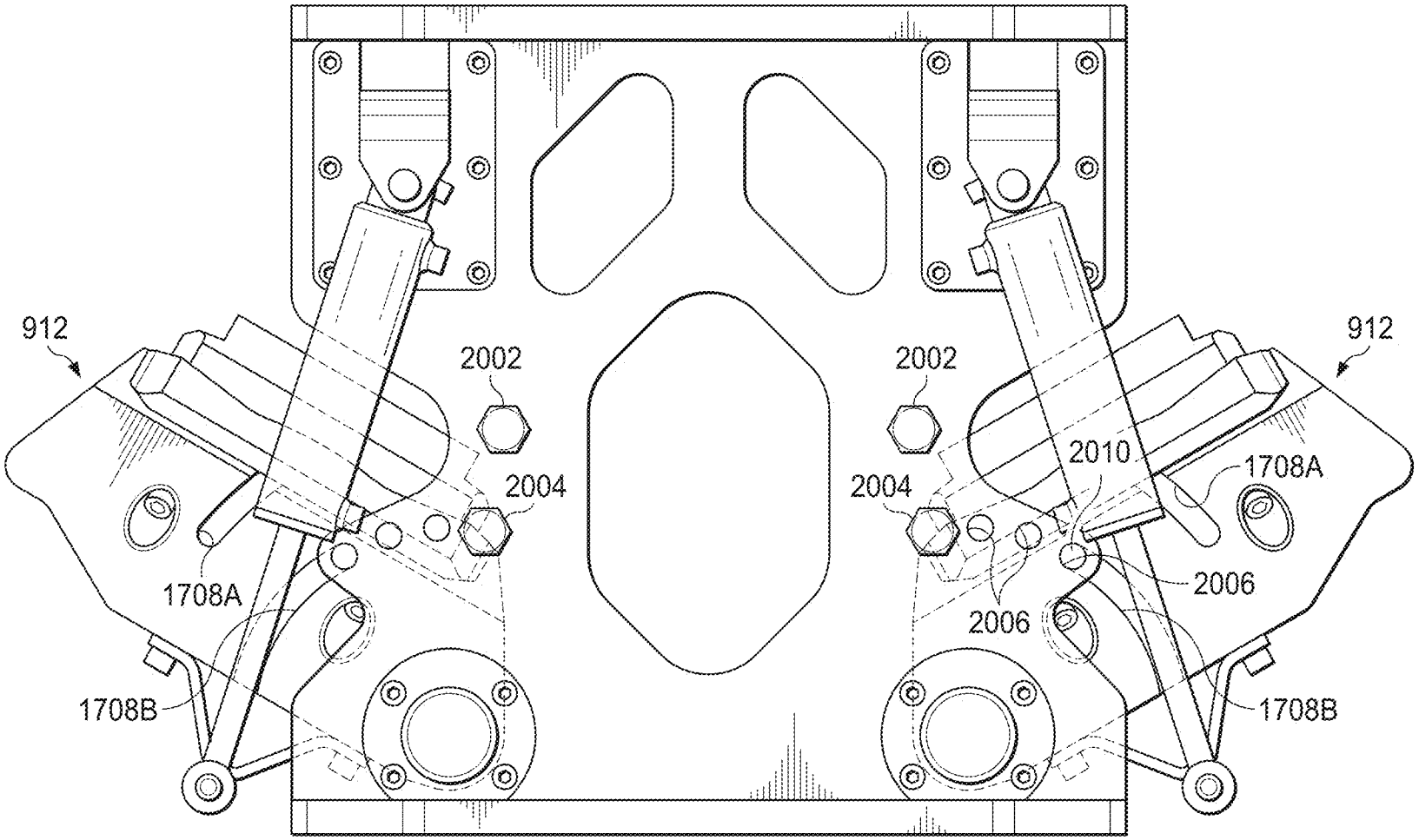
FIG. 20 illustrates the components for limiting the opening and closing limits of the pivot arms.

Referring now to FIG. 20, there is illustrated the operation of the stop channels 1708 and the stop bolts 2002 and 2004. The purposes of the stop channels 1708 and the stop bolts 2002 and 2004 are to limit the opening and closing movement of the pivot arm 912 with respect to the support frame 904. The stop channels 1708 comprise curved channels that are cut into each side of the pivot arm 912. The stop bolts 2002 and 2004 comprise a closing stop bolt 2002 that engages upper stop channel 1708A and an opening stop bolt 2004 that engages the lower stop channel 1708B. The closing stop bolt 2002 has a fixed position and the closing stop bolt engages the end 2006 of the upper stop channel 1708A when the pivot arm 912 rotates to the closed position around the tubular. The closing stop bolt 2002 and the upper stop channel 1708A work together to prevent the pivot arm from closing past a particular point around a tubular within the slip bowl 902.

Similarly, the closing stop bolt 2004 and the lower stop channel 1708B control the amount that the pivot arm 912 opens when allowing a tubular to pass through the slip bowl 902. A plurality of holes 2008 allow the lower stop bolt 2004 to be moved to a variety of positions. The lower stop bolt 2004 will engage the end 2010 of the lower stop channel 1708B to prevent the pivot arm from opening any further. The hole 2008 located closest to the edge of the central support frame 910 allows the pivot arm 912 to open the greatest amount. The hole 206 located closest to the center of the central support frame 910 allows the pivot arm 912 to open the smallest amount. The intermediate holes 206 provide various intermediate levels of opening. The ability to adjust the amount that the pivot arm 912 will open using the lower stop bolt 2004 and the lower stop channel 1708B enables control of the opening of the gripping inserts to accommodate the passing of pipe collars that interconnect pipe sections. However, the pivot arm 912 have to open enough to pass the collar of a specific size every time as the tubular passes through the slip bowl 90 but the pivot arms do not have to open large enough large enough to pass a collar of pipe larger than the gripping inserts that are installed at the time.

Figure 21:
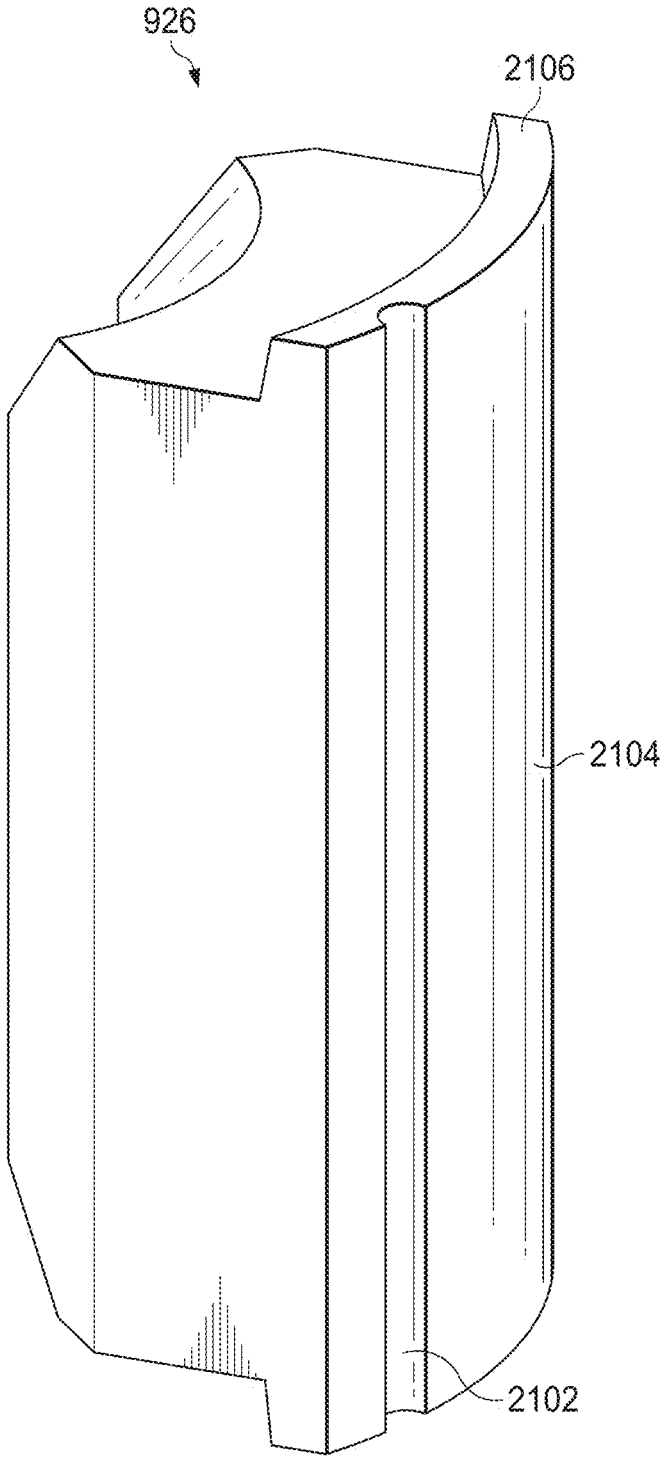
FIG. 21 illustrates a perspective view of the gripping insert and its retaining rod channel.
Figure 22:
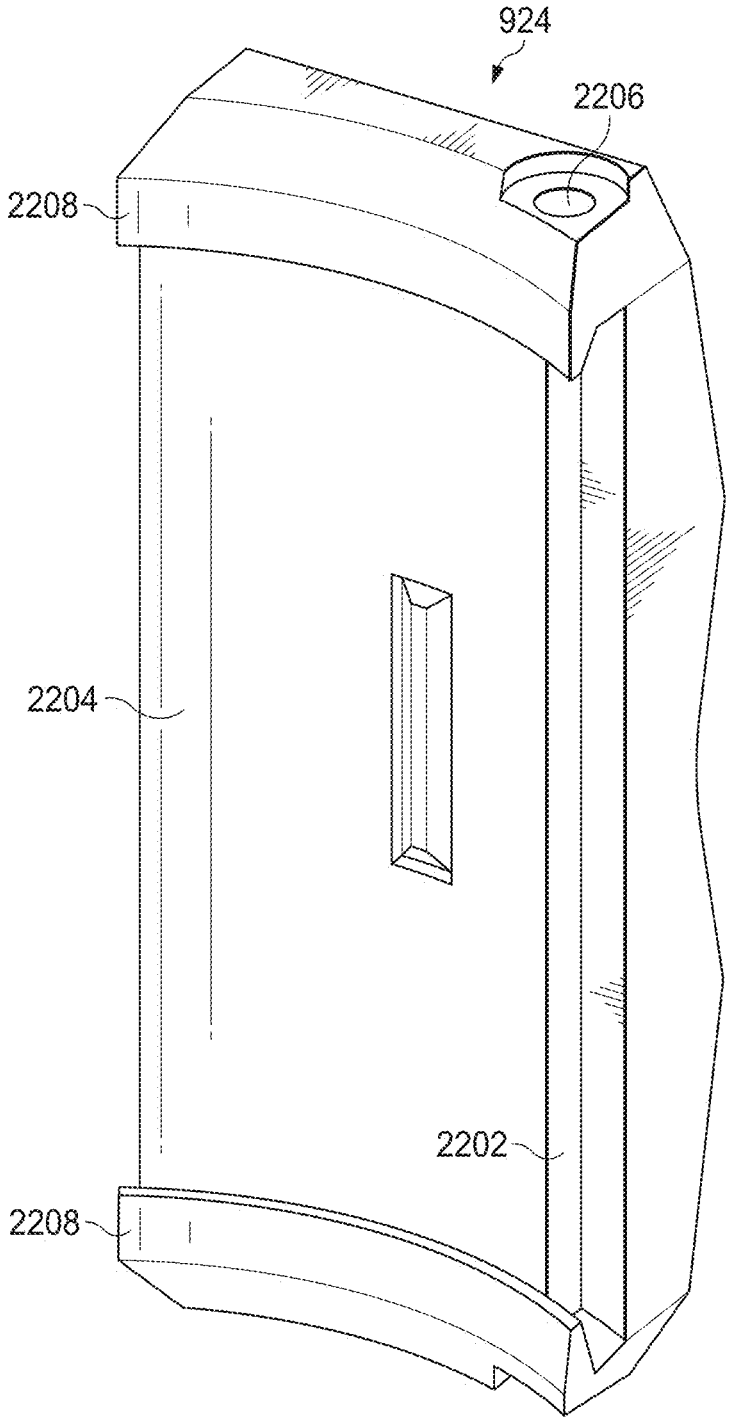
FIG. 22 illustrates a perspective view of the carrier plate and its retaining rod channel.
Figure 23:
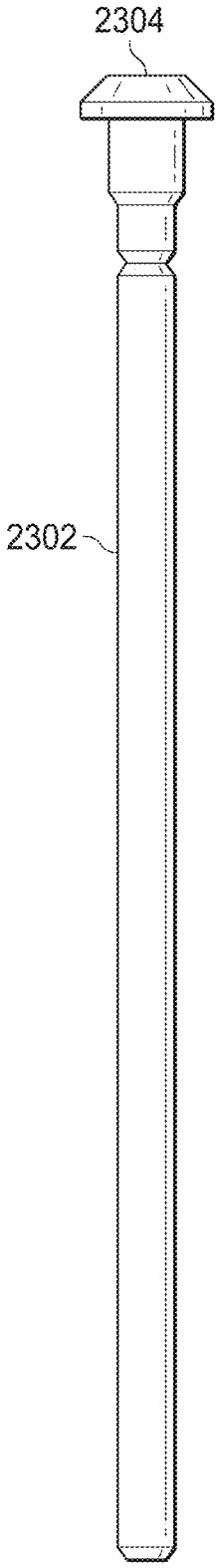
FIG. 23 illustrates the retaining rod for securing the gripping insert within the carrier plate.

Referring now to FIGS. 21-23, there is illustrated the manner for providing retained gripping inserts 926 within the carrier 924. FIG. 21 illustrates the gripping insert 926. The gripping insert 926 has a channel 2102 defined in the back surface 2104 thereof in order to receive a retaining rod 2302 as more particularly illustrated in FIG. 23. The channel 2102 is offset from the centerline of the gripping insert 926. This distinguishes from standard Cavins pipe dies that have a centrally located groove in the back for restraining an insert. The carrier plate 924, as shown in FIG. 24, also has a channel 2202 defined in the front surface 2204 thereof. An opening 2406 defined in the top of the carrier 924 enables insertion of the retaining rod 2302. A back tab 2106 is inserted within the retaining holders 2208 defined at the top and the bottom of the carrier plate 924. The gripping insert 926 slides into place within the carrier plate 924 until the channel 2102 defined within the back surface 2104 of the carrier plate aligns with the channel 2202 defined in the surface 2204 of the carrier plate 924. When the two channels 2102 and 2202 align, a circular passageway is defined between the gripping insert 926 and the carrier plate 924. The retaining rod 2302 of FIG. 23 may then be inserted into the hole 2206 of the carrier plate 924. The retaining rod 2304 includes integrated fastening threads that threadedly engage with threads defined within the hole 2206. The retaining rod 2302 passes down the channel defined between the gripping insert 926 and the carrier plate 924 until the top head 2304 engages a ledge surrounding the hole 2206 on the carrier plate 924. The retaining rod 2302 may be maintained within the channel by some type of securing mechanism or retaining tab placed across the top of the head 2304 of the retaining rod 2302. The retaining rod 2302 prevents the gripping insert 926 from rotating out of the carrier plate 924.

It will be appreciated by those skilled in the art having the benefit of this disclosure that this omnidirectional slip bowl provides a single slip bowl for supporting tubular weight either down into or out of the drill hole. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An omnidirectional slip bowl comprising:

a support frame having a central axis and defining an opening therein to receive a tubular passing into or coming out of a wellbore;

a pair of pivot arms for moving between an open configuration and a closed configuration, each of the pair of pivot arms located on opposite sides of the support frame;

a plurality of actuators each having a first end connected to one of the pair of pivot arms, wherein each of the plurality of actuators moves an associated pivot arm between the open configuration and the closed configuration;

a plurality of pairs of gripper mechanisms associated with each one of the pair of pivot arms for locking the tubular in a fixed position and preventing movement of the tubular into or out of the wellbore;

wherein when the pair of pivot arms are in the closed configuration and the tubular is moving out of the wellbore, the plurality of pairs of gripper assemblies move in a first direction along the pair of pivot arms and engage the tubular to prevent the tubular moving out of the wellbore; and wherein when the pair of pivot arms are in the closed configuration and the tubular is moving into the wellbore, the plurality of pairs of gripper assemblies move in a second direction along a pivot arm and engage the tubular to prevent the tubular moving into the wellbore.

2. The omnidirectional slip bowl of claim 1, wherein the support frame comprises a plurality of separate portions that are bolted together.

3. The omnidirectional slip bowl of claim 1 further comprising:

a pair of cylindrical members for slidably engaging the support frame in a direction parallel to the central axis of the support frame, each cylindrical member of the pair of cylindrical members connected to a pair of the plurality of actuators to move the cylindrical member between the open configuration and the closed configuration;

a pair of locking bars each connected to one of the pair of cylindrical members and extending downward therefrom, wherein the pair of locking bars engage the pair of pivot arms in the closed configuration to maintain the pair of pivot arms in the closed configuration;

at least one bias spring each having a first end connected to the pair of locking bars and a second end connected to the support frame, wherein the at least one bias spring biases the pair of locking bars to press down on the pair of pivot arms; and at least one lift rod fixedly connected to the pair of locking bars and slidably connected to the pair of cylindrical members, wherein the at least one lift rod lifts the pair of locking bars off of the pair of pivot arms responsive to raising of the pair of cylindrical members in the open configuration and enables the pair of cylindrical members to push the pair of locking bars against the pair of pivot arms in the closed configuration.

4. The omnidirectional slip bowl of claim 3, wherein the support frame further comprises cylindrical body acting as a wear insert removably connected to the support frame at areas wherein the pair of members slidably engages the support frame.

5. The omnidirectional slip bowl of claim 1, wherein each of the plurality of pairs of gripper assemblies further comprises:

a first biasing spring for biasing a gripper assembly of the plurality of pairs of gripper assemblies in a downward direction along the central axis of the support frame;

a second biasing spring for biasing the gripper assembly in an upward direction along the central axis of the support frame; and wherein the first biasing spring and the second biasing spring maintain the gripper assembly in a neutral position when no forces are applied to the gripper assembly by the tubular.

6. The omnidirectional slip bowl of claim 5, wherein each of the plurality of pairs of gripper assemblies further comprises at least one biasing spring for biasing the gripper assembly in a perpendicular direction to the central axis of the support frame and towards the central axis of the support frame.

7. The omnidirectional slip bowl of claim 1, wherein the support frame further comprises a pivot arm wear insert removably connected to the support frame at pivot points between the support frame and the pair of pivot arms.

8. The omnidirectional slip bowl of claim 1, wherein the pair of pivot arms further comprises:

at least one first slot defined within each of the pair of pivot arms for limiting an opening position of the pair of pivot arms in the open configuration;

at least one second slot defined within each of the pair of pivot arms for limiting a closing position of the pair of pivot arms in the closed configuration;

a first bolt for engaging the at least one first slot to stop a pivot arm at a first predetermined position for the opening position, wherein the first bolt is further moveable to a plurality of positions to enable a plurality of first predetermined positions for the opening position; and a second bolt for engaging the at least one second slot to stop the pivot arm at a second predetermined position for the opening position.

9. The omnidirectional slip bowl of claim 1, wherein each of the plurality of pairs of gripper assemblies further comprises:

a pipe insert for engaging the tubular in the closed configuration to prevent the tubular from moving perpendicular to the central axis of the support frame, wherein a backside of the pipe insert defines a first channel half therein;

a carrier having a first side for supporting the pipe insert and defining a second channel half therein, wherein upon connection of the pipe insert with the carrier the first channel half aligns with the second channel half to define a retaining channel; and a retaining rod inserted into the retaining channel to maintain the connection between the pipe insert and the carrier.

10. The omnidirectional slip bowl of claim 9, wherein each of the plurality of pairs of gripper assemblies further comprises:

wherein a second side of the carrier further defines a first plurality of alternately angled surfaces, wherein a first portion of the first plurality of alternately angled surfaces are angled in a first direction and a second portion of the first plurality of alternately angled surfaces are angled in a second direction; and a slide plate having a first side for engaging one of the pair of pivot arms and a second side defining a second plurality of alternately angled surfaces, wherein a first portion of the second plurality of alternately angled surfaces are angled in the first direction and a second portion of the second plurality of alternately angled surfaces are angled in the second direction.

11. An omnidirectional slip bowl comprising:

a support frame having a central axis and defining an opening therein to receive a tubular passing into or coming out of a wellbore;

a pair of pivot arms for moving between an open configuration and a closed configuration, each of the pair of pivot arms located on opposite sides of the support frame;

a plurality of hydraulic actuators each having a first end connected to one of the pair of pivot arms, wherein each of the plurality of hydraulic actuators moves an associated pivot arm between the open configuration and the closed configuration;

a pair of cylindrical members for slidably engaging the support frame in a direction parallel to the central axis of the support frame, each cylindrical member of the pair of cylindrical members connected to a pair of the plurality of hydraulic actuators to move the cylindrical member between the open configuration and the closed configuration;

a pair of locking bars each connected to one of the pair of cylindrical members and extending downward therefrom, wherein the pair of locking bars engage the pair of pivot arms in the closed configuration to maintain the pair of pivot arms in the closed configuration;

at least one bias spring each having a first end connected to the pair of locking bars and a second end connected to the support frame, wherein the at least one bias spring biases the pair of locking bars to press down on the pair of pivot arms;

at least one lift rod fixedly connected to the pair of locking bars and slidably connected to the pair of cylindrical members, wherein the at least one lift rod lifts the pair of locking bars off of the pair of pivot arms responsive to raising of the pair of cylindrical members in the open configuration and enables the pair of cylindrical members to push the pair of locking bars against the pair of pivot arms in the closed configuration;

a plurality of pairs of gripper assemblies associated with each one of the pair of pivot arms for locking the tubular in a fixed position and preventing movement of the tubular into or out of the wellbore, wherein the plurality of pairs of gripper assemblies further comprises:

a pipe insert for engaging the tubular in the closed configuration to prevent the tubular from moving perpendicular to the central axis of the support frame, wherein a backside of the pipe insert defines a first channel half therein;

a carrier having a first side for supporting the pipe insert and defining a second channel half therein, wherein upon connection of the pipe insert with the carrier the first channel half aligns with the second channel half to define a retaining channel;

a retaining rod inserted into the retaining channel to maintain the connection between the pipe insert and the carrier;

wherein when the pair of pivot arms are in the closed configuration and the tubular is moving out of the wellbore, the plurality of pairs of gripper assemblies move in a first direction along the pair of pivot arms and engage the tubular to prevent the tubular moving out of the wellbore; and wherein when the pair of pivot arms are in the closed configuration and the tubular is moving into the wellbore, the plurality of pairs of gripper assemblies move in a second direction along a pivot arm and engage the tubular to prevent the tubular moving into the wellbore.

12. The omnidirectional slip bowl of claim 11, wherein the support frame comprises a plurality of separate portions that are bolted together.

13. The omnidirectional slip bowl of claim 11, wherein the support frame further comprises a cylindrical body acting as a wear insert removably connected to the support frame at areas wherein the cylindrical member slidably engages the support frame.

14. The omnidirectional slip bowl of claim 11, wherein each of the plurality of pairs of gripper assemblies further comprises:

a first biasing spring for biasing a gripper assembly of the plurality of pairs of gripper assemblies in a downward direction along the central axis of the support frame;

a second biasing spring for biasing the gripper assembly in an upward direction along the central axis of the support frame; and wherein the first biasing spring and the second biasing spring maintain the gripper assembly in a neutral position when no forces are applied to the gripper assembly by the tubular.

15. The omnidirectional slip bowl of claim 14, wherein each of the plurality pairs of gripper assemblies further comprises at least one biasing spring for biasing the gripper assembly in a perpendicular direction to the central axis of the support frame and towards the central axis of the support frame.

16. The omnidirectional slip bowl of claim 11, wherein the support frame further comprises a pivot arm removably connected to the support frame at pivot points between the support frame and the pair of pivot arms.

17. The omnidirectional slip bowl of claim 11, wherein the pair of pivot arms further comprises:

at least one first slot defined within each of the pair of pivot arms for limiting an opening position of the pair of pivot arms in the open configuration;

at least one second slot defined within each of the pair of pivot arms for limiting a closing position of the pair of pivot arms in the closed configuration;

a first bolt for engaging the at least one first slot to stop a pivot arm at a first predetermined position for the opening position, wherein the first bolt is further moveable to a plurality of positions to enable a plurality of first predetermined positions for the opening position; and a second bolt for engaging the at least one second slot to stop the pivot arm at a second predetermined position for the opening position.

18. The omnidirectional slip bowl of claim 11, wherein each of the plurality of pairs of gripper assemblies further comprises:

wherein a second side of the carrier further defines a first plurality of alternately angled surfaces, wherein a first portion of the first plurality of alternately angled surfaces are angled in a first direction and a second portion of the first plurality of alternately angled surfaces are angled in a second direction; and a slide plate having a first side for engaging one of the pair of pivot arms and a second side defining a second plurality of alternately angled surfaces, wherein a first portion of the second plurality of alternately angled surfaces are angled in the first direction and a second portion of the second plurality of alternately angled surfaces are angled in the second direction.

19. An omnidirectional slip bowl comprising:

a support frame having a central axis and defining an opening therein to receive a tubular passing into or coming out of a wellbore;

a pair of pivot arms for moving between an open configuration and a closed configuration, each of the pair of pivot arms located on opposite sides of the support frame, wherein the pair of pivot arms further comprises:

at least one first slot defined within each of the pair of pivot arms for limiting an opening position of the pair of pivot arms in the open configuration;

at least one second slot defined within each of the pair of pivot arms for limiting a closing position of the pair of pivot arms in the closed configuration;

a first bolt for engaging the at least one first slot to stop a pivot arm at a first predetermined position for the opening position, wherein the first bolt is further moveable to a plurality of positions to enable a plurality of first predetermined positions for the opening position; and a second bolt for engaging the at least one second slot to stop the pivot arm at a second predetermined position for the opening configuration;

a plurality of hydraulic actuators each having a first end connected to one of the pair of pivot arms, wherein each of the plurality of hydraulic actuators moves an associated pivot arm between the open configuration and the closed configuration;

a pair of cylindrical members for slidably engaging the support frame in a direction parallel to the central axis of the support frame, each cylindrical member of the pair of cylindrical members connected to a pair of the plurality of hydraulic actuators to move the cylindrical member between the open configuration and the closed configuration;

a pair of locking bars each connected to one of the pair of cylindrical members and extending downward therefrom, wherein the pair of locking bars engage the pair of pivot arms in the closed configuration to maintain the pair of pivot arms in the closed configuration;

at least one bias spring each having a first end connected to the pair of locking bars and a second end connected to the support frame, wherein the at least one bias spring biases the pair of locking bars to press down on the pair of pivot arms;

at least one lift rod fixedly connected to the pair of locking bars and slidably connected to the pair of cylindrical members, wherein the at least one lift rod lifts the pair of locking bars off of the pair of pivot arms responsive to raising of the pair of cylindrical members in the open configuration and enables the pair of cylindrical members to push the pair of locking bars against the pair of pivot arms in the closed configuration;

a plurality of pairs of gripper mechanisms associated with each one of the pair of pivot arms for locking the tubular in a fixed position and preventing movement of the tubular into or out of the wellbore;

wherein when the pair of pivot arms are in the closed configuration and the tubular is moving out of the wellbore, the plurality of pairs of gripper assemblies move in a first direction along the pair of pivot arms and engage the tubular to prevent the tubular moving out of the wellbore; and wherein when the pair of pivot arms are in the closed configuration and the tubular is moving into the wellbore, the plurality of pairs of gripper assemblies move in a second direction along the pivot arm and engage the tubular to prevent the tubular moving into the wellbore.

20. The omnidirectional slip bowl of claim 19, wherein each of the plurality of pairs of gripper assemblies further comprises:

a first biasing spring for biasing a gripper assembly of the plurality of pairs of gripper assemblies in a downward direction along the central axis of the support frame;

a second biasing spring for biasing the gripper assembly in an upward direction along the central axis of the support frame; and wherein the first biasing spring and the second biasing spring maintain the gripper assembly in a neutral position when no forces are applied to the gripper assembly by the tubular.

21. The omnidirectional slip bowl of claim 20, wherein each of the plurality of pairs of gripper assemblies further comprises at least one biasing spring for biasing the gripper assembly in a perpendicular direction to the central axis of the support frame and towards the central axis of the support frame.

* * * * *